US009565910B2

(12) United States Patent
Magness

(10) Patent No.: US 9,565,910 B2
(45) Date of Patent: Feb. 14, 2017

(54) WATERPROOF PROTECTIVE CASE FOR AN ELECTRONIC DEVICE

(71) Applicant: Otter Products, LLC, Fort Collins, CO (US)

(72) Inventor: Cameron D. Magness, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 14/944,586

(22) Filed: Nov. 18, 2015

(65) Prior Publication Data

US 2016/0073748 A1 Mar. 17, 2016

Related U.S. Application Data

(63) Continuation of application No. 14/280,664, filed on May 18, 2014, now Pat. No. 9,220,328.

(60) Provisional application No. 61/824,991, filed on May 18, 2013.

(51) Int. Cl.

| | |
|---|---|
| ***B65D 43/16*** | (2006.01) |
| ***A45C 11/00*** | (2006.01) |
| ***A45C 13/00*** | (2006.01) |

(52) U.S. Cl.

CPC ..... *A45C 11/00* (2013.01); *A45C 13/008* (2013.01); *A45C 2011/001* (2013.01); *A45C 2011/002* (2013.01); *A45C 2011/003* (2013.01); *A45C 2200/10* (2013.01)

(58) Field of Classification Search

CPC ..... A45C 13/008; A45C 11/00; A45C 2011/001–2011/003

USPC ..... 206/320, 370; 220/4.22–4.24

See application file for complete search history.

(56) References Cited

U.S. PATENT DOCUMENTS

| | | | |
|---|---|---|---|
| 2,392,787 | A | 1/1946 | Edmond |
| 3,023,885 | A | 3/1962 | Kindseth |
| 3,482,895 | A | 12/1969 | Becklin |
| 3,665,991 | A | 5/1972 | Gillemot et al. |
| 3,832,725 | A | 8/1974 | Cook |
| D243,698 | S | 3/1977 | Gietzen |

(Continued)

FOREIGN PATENT DOCUMENTS

| | | | |
|---|---|---|---|
| DE | 29612454 | U1 | 9/1996 |
| EP | 1018680 | A2 | 7/2000 |

(Continued)

OTHER PUBLICATIONS

Intl. Search Report and Written Opinion dated Jun. 18, 2015 for PCT/US14/038527.

*Primary Examiner* — Anthony Stashick
*Assistant Examiner* — Raven Collins

(57) ABSTRACT

A waterproof protective case can include a front portion and a back portion configured to attach to the front portion to form the protective case. The waterproof protective case may include a port cover for covering and sealing a port opening near a feature, such as an electrical port. The port cover may include a gasket to seal the port opening, as well as a flexible member with a thinned area that flexes to allow the port cover to open and close. The protective case may include an aperture covered by a membrane to allow sound transmission through the case, and the flexible member of the port cover may include at least one opening to allow sound transmission through the flexible member. The port cover may also include an aperture covered by a membrane to allow sound transmission through the port cover.

24 Claims, 30 Drawing Sheets

(56) References Cited

U.S. PATENT DOCUMENTS 4,097,878 A 6/1978 Cramer
4,298,204 A 11/1981 Jinkins
4,312,580 A 1/1982 Schwomma et al.
4,335,930 A 6/1982 Feldman
4,352,968 A 10/1982 Pounds
D267,713 S 1/1983 Noda et al.
4,375,323 A 3/1983 Inagaki et al.
4,383,743 A 5/1983 Nozawa et al.
4,418,830 A 12/1983 Dzung et al.
4,420,078 A 12/1983 Belt et al.
4,546,874 A 10/1985 Kirchhan
4,584,718 A 4/1986 Fuller
4,649,453 A 3/1987 Iwasawa
4,658,956 A 4/1987 Takeda et al.
4,683,587 A 7/1987 Silverman
4,686,332 A 8/1987 Greanias et al.
4,703,161 A 10/1987 McLean
4,712,657 A 12/1987 Myers et al.
4,733,776 A 3/1988 Ward
4,762,227 A 8/1988 Patterson
4,803,504 A 2/1989 Maeno et al.
4,836,256 A 6/1989 Meliconi
4,942,514 A 7/1990 Miyagaki et al.
4,963,902 A 10/1990 Fukahori
4,977,483 A 12/1990 Perretta
D313,790 S 1/1991 Hirabayashi
4,994,829 A 2/1991 Tsukamoto
5,002,184 A 3/1991 Lloyd
D316,932 S 5/1991 Escher
5,025,921 A 6/1991 Gasparaitis et al.
D322,165 S 12/1991 Lloyd
5,087,934 A 2/1992 Johnson
5,092,458 A 3/1992 Yokoyama
5,092,459 A 3/1992 Uljanic et al.
D328,280 S 7/1992 Lee
5,175,873 A 12/1992 Goldenberg et al.
5,177,515 A 1/1993 Tsukamoto
5,231,381 A 7/1993 Duwaer
5,233,502 A 8/1993 Beatty et al.
5,239,323 A 8/1993 Johnson
5,239,324 A 8/1993 Ohmura et al.
5,285,894 A 2/1994 Kamata et al.
5,294,988 A 3/1994 Wakabayashi et al.
5,305,032 A 4/1994 Arai
5,336,896 A 8/1994 Katz
5,360,108 A 11/1994 Alagia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
D365,927 S 1/1996 Cho
5,505,328 A 4/1996 Stribiak
5,508,479 A 4/1996 Schooley
5,541,813 A 7/1996 Satoh et al.
RE35,318 E 8/1996 Warman
5,548,306 A 8/1996 Yates et al.
5,583,742 A 12/1996 Noda et al.
5,584,054 A 12/1996 Tyneski et al.
5,590,760 A 1/1997 Astarb
5,610,655 A 3/1997 Wakabayashi et al.
D378,634 S 4/1997 LaPere
5,636,101 A 6/1997 Bonsall et al.
5,669,004 A 9/1997 Sellers
5,681,122 A 10/1997 Burke
5,707,757 A 1/1998 Lee
5,713,048 A 1/1998 Hayakawa
5,713,466 A 2/1998 Tajima
D399,185 S 10/1998 Lin
5,845,803 A 12/1998 Saito et al.
5,850,915 A 12/1998 Tajima
5,907,721 A 5/1999 Schelling et al.
5,946,501 A 8/1999 Hayakawa
5,956,291 A 9/1999 Nehemiah et al.
5,982,520 A 11/1999 Weiser et al.
5,990,874 A 11/1999 Tsumura et al.
D419,297 S 1/2000 Richardson et al.
D419,768 S 2/2000 Richardson et al.
6,041,924 A 3/2000 Tajima
D424,035 S 5/2000 Steiner et al.
6,068,119 A 5/2000 Derr et al.
6,092,707 A 7/2000 Bowes
6,094,785 A 8/2000 Montgomery et al.
6,128,441 A 10/2000 Kamata et al.
6,132,367 A 10/2000 Adair
6,201,867 B1 3/2001 Koike
D447,634 S 9/2001 Snider
6,304,459 B1 10/2001 Toyosato et al.
6,311,017 B1 10/2001 Mori
6,313,982 B1 11/2001 Hino
6,317,313 B1 11/2001 Mosgrove et al.
6,349,824 B1 2/2002 Yamada
6,388,877 B1 5/2002 Canova et al.
6,396,769 B1 5/2002 Polany
6,415,138 B2 7/2002 Sirola et al.
6,445,577 B1 9/2002 Madsen et al.
6,456,487 B1 9/2002 Hetterick
D464,196 S 10/2002 Parker
6,471,056 B1 10/2002 Tzeng
6,519,141 B2 2/2003 Tseng et al.
6,525,928 B1 2/2003 Madsen et al.
6,532,152 B1 3/2003 White et al.
6,536,589 B2 3/2003 Chang
6,571,056 B2 5/2003 Shimamura et al.
D475,348 S 6/2003 Heiligenstein et al.
6,574,434 B2 6/2003 Matsuoto et al.
6,594,472 B1 7/2003 Curtis et al.
6,595,608 B1 7/2003 Minelli et al.
6,597,865 B1 7/2003 Negishi et al.
6,614,423 B1 9/2003 Wong et al.
6,614,722 B2 9/2003 Polany et al.
6,616,111 B1 9/2003 White
6,617,973 B1 9/2003 Osterman
6,625,394 B2 9/2003 Smith et al.
6,634,494 B1 10/2003 Derr et al.
6,636,697 B2 10/2003 Smith et al.
6,646,864 B2 11/2003 Richardson
6,659,274 B2 12/2003 Enners
6,665,174 B1 12/2003 Derr et al.
6,669,017 B2 12/2003 Linihan
6,698,608 B2 3/2004 Parker et al.
6,721,651 B1 4/2004 Minelli
6,751,552 B1 6/2004 Minelli
6,760,570 B1 7/2004 Higdon
6,778,388 B1 8/2004 Minelli
6,785,566 B1 8/2004 Irizarry
6,819,866 B2 11/2004 Silva
6,822,161 B2 11/2004 Komatsu et al.
6,822,640 B2 11/2004 Derocher
6,844,845 B1 1/2005 Whiteside et al.
6,913,201 B1 7/2005 Wagner et al.
6,914,774 B1 7/2005 Albertini et al.
D507,871 S 8/2005 DiMarchi et al.
6,953,126 B2 10/2005 Parker et al.
6,954,405 B2 10/2005 Polany et al.
6,955,293 B1 10/2005 Katsanevas
6,971,517 B2 12/2005 Chen
6,975,888 B2 12/2005 Buesseler et al.
6,980,777 B2 12/2005 Shepherd et al.
6,983,130 B2 1/2006 Chien et al.
6,987,527 B2 1/2006 Kossin
6,992,659 B2 1/2006 Gettemy
6,995,976 B2 2/2006 Richardson
D516,807 S 3/2006 Richardson et al.
7,046,230 B2 5/2006 Zadesky et al.
7,050,712 B2 5/2006 Shimamura
7,050,841 B1 5/2006 Onda
7,054,441 B2 5/2006 Pletikosa
7,061,762 B2 6/2006 Canova et al.
7,069,063 B2 6/2006 Halkosaari et al.
7,082,264 B2 7/2006 Watanabe et al.
7,085,542 B2 8/2006 Dietrich et al.
7,089,547 B2 8/2006 Goodman et al.

(56) References Cited

U.S. PATENT DOCUMENTS 7,106,959 B2 9/2006 Sato
D530,079 S 10/2006 Thomas et al.
7,146,701 B2 12/2006 Mahoney et al.
7,158,376 B2 1/2007 Richardson et al.
7,180,735 B2 2/2007 Thomas et al.
7,194,086 B2 3/2007 Pletikosa
7,194,202 B2 3/2007 Funahashi et al.
7,194,291 B2 3/2007 Peng
D543,509 S 5/2007 Victor
7,230,823 B2 6/2007 Richardson et al.
7,236,588 B2 6/2007 Gartrell
7,255,228 B2 8/2007 Kim
7,263,032 B2 8/2007 Polany et al.
D550,623 S 9/2007 McCann
7,312,984 B2 12/2007 Richardson et al.
7,341,144 B2 3/2008 Tajiri et al.
7,343,184 B2 3/2008 Rostami
7,352,961 B2 4/2008 Watanabe et al.
7,362,570 B2 4/2008 Su
7,365,281 B2 4/2008 Yamaguchi et al.
7,366,555 B2 4/2008 Jokinen et al.
7,369,881 B2 5/2008 Tsujimoto
7,389,869 B2 6/2008 Mason
7,400,917 B2 7/2008 Wood et al.
D574,819 S 8/2008 Andre et al.
D575,056 S 8/2008 Tan
7,409,148 B2 8/2008 Takahashi et al.
7,418,278 B2 8/2008 Eriksson et al.
7,428,427 B2 9/2008 Brunstrom et al.
7,436,653 B2 10/2008 Yang et al.
D581,421 S 11/2008 Richardson et al.
D582,149 S 12/2008 Tan
7,464,813 B2 12/2008 Carnevali
7,464,814 B2 12/2008 Carnevali
7,495,659 B2 2/2009 Marriott et al.
7,495,895 B2 2/2009 Carnevali
7,499,040 B2 3/2009 Zadesky et al.
7,502,550 B2 3/2009 Ariga
7,511,956 B2 3/2009 Tomioka et al.
7,525,792 B2 4/2009 Yokote
7,535,799 B2 5/2009 Polany et al.
D593,319 S 6/2009 Richardson et al.
7,558,594 B2 7/2009 Wilson
7,594,576 B2 9/2009 Chen et al.
7,609,512 B2 10/2009 Richardson et al.
7,613,386 B2 11/2009 Shimamura
7,623,898 B2 11/2009 Holmberg
D605,850 S 12/2009 Richardson et al.
7,630,746 B2 12/2009 Holmberg
7,653,292 B2 1/2010 Yamaguchi et al.
7,663,878 B2 2/2010 Swan et al.
7,663,879 B2 2/2010 Richardson et al.
7,679,674 B2 3/2010 Nishizawa
7,688,580 B2 3/2010 Richardson et al.
7,697,269 B2 4/2010 Yang et al.
D616,430 S 5/2010 Fathollahi
7,711,400 B2 5/2010 Nuovo
7,733,642 B2 6/2010 Liou et al.
7,755,975 B2 7/2010 Pettersen et al.
7,772,507 B2 8/2010 Orr et al.
7,775,354 B2 8/2010 Latchford et al.
7,787,756 B2 8/2010 Funahashi et al.
7,789,228 B2 9/2010 Zenzai
7,789,696 B2 9/2010 Umei et al.
7,801,425 B2 9/2010 Fantone et al.
7,854,434 B2 12/2010 Heiman et al.
7,889,489 B2 2/2011 Richardson et al.
7,907,394 B2 3/2011 Richardson et al.
7,926,818 B2 4/2011 Isono
7,933,122 B2 4/2011 Richardson et al.
7,936,566 B2 5/2011 Shigyo et al.
7,941,196 B2 5/2011 Kawasaki et al.
7,944,697 B2 5/2011 Hata et al.
7,975,870 B2 7/2011 Laule et al.
7,978,092 B2 7/2011 Osaka
D644,636 S 9/2011 Richardson et al.
8,024,015 B2 9/2011 Araki et al.
8,031,472 B2 10/2011 Bicket et al.
8,032,194 B2 10/2011 Liu et al.
8,053,668 B2 11/2011 Lai et al.
8,068,331 B2 11/2011 Sauers et al.
8,089,757 B2 1/2012 Chen et al.
8,138,434 B2 3/2012 Tang et al.
8,164,899 B2 4/2012 Yamaguchi et al.
8,167,126 B2 5/2012 Stiehl
8,191,706 B1 6/2012 Liu
8,204,561 B2 6/2012 Mongan et al.
8,223,997 B2 7/2012 Wilson, II et al.
8,251,210 B2 8/2012 Schmidt et al.
8,265,264 B2 9/2012 Yamaguchi et al.
8,269,104 B2 9/2012 Choraku et al.
8,286,789 B2 10/2012 Wilson et al.
8,311,595 B2 11/2012 Takatsuka et al.
8,342,325 B2 1/2013 Rayner
8,373,980 B2 2/2013 Reber
8,393,466 B2 3/2013 Rayner
8,400,408 B2 3/2013 Hotelling et al.
8,430,240 B2 4/2013 Kim
D682,817 S 5/2013 Murchison et al.
8,454,101 B2 6/2013 Kuo
2001/0040109 A1 11/2001 Yaski et al.
2002/0003584 A1 1/2002 Kossin
2002/0009195 A1 1/2002 Schon
2002/0065054 A1 5/2002 Humphreys et al.
2002/0071550 A1 6/2002 Pletikosa
2002/0079244 A1 6/2002 Kwong
2002/0085709 A1 7/2002 Hsu
2002/0090212 A1 7/2002 Shimamura et al.
2002/0122353 A1 9/2002 Polany et al.
2002/0136557 A1 9/2002 Shimamura
2002/0137475 A1 9/2002 Shou et al.
2002/0175096 A1 11/2002 Linihan
2002/0175901 A1 11/2002 Gettemy
2002/0193136 A1 12/2002 Halkosaari et al.
2002/0195910 A1 12/2002 Hus et al.
2003/0080947 A1 5/2003 Genest et al.
2003/0095374 A1 5/2003 Richardson
2003/0111366 A1 6/2003 Enners
2003/0118332 A1 6/2003 Smith et al.
2003/0118334 A1 6/2003 Smith et al.
2003/0128397 A1 7/2003 Smith et al.
2003/0223577 A1 12/2003 Ono
2004/0014506 A1 1/2004 Kemppinen
2004/0076415 A1 4/2004 Silva
2004/0089570 A1 5/2004 Chien et al.
2004/0120219 A1 6/2004 Polany et al.
2004/0188120 A1 9/2004 Komatsu et al.
2004/0203502 A1 10/2004 Dietrich et al.
2004/0226836 A1 11/2004 Schreiber et al.
2005/0052425 A1 3/2005 Zadesky et al.
2005/0110768 A1 5/2005 Marriott et al.
2005/0115852 A1 6/2005 Funahashi et al.
2005/0123161 A1 6/2005 Polany et al.
2005/0167304 A1 8/2005 Shimamura
2005/0174727 A1 8/2005 Thomas et al.
2005/0181843 A1 8/2005 Tsujimoto
2005/0224508 A1 10/2005 Tajiri et al.
2005/0247584 A1 11/2005 Lu
2005/0279661 A1 12/2005 Hodges
2006/0008261 A1 1/2006 Watanabe et al.
2006/0110146 A1 5/2006 Ariga
2006/0255493 A1 11/2006 Fouladpour
2007/0040931 A1 2/2007 Nishizawa
2007/0071423 A1 3/2007 Fantone et al.
2007/0074473 A1 4/2007 Yamaguchi et al.
2007/0086273 A1 4/2007 Polany et al.
2007/0109730 A1 5/2007 Shigyo et al.
2007/0110416 A1 5/2007 Yamaguchi et al.
2007/0115387 A1 5/2007 Ho
2007/0138920 A1 6/2007 Austin et al.
2007/0146985 A1 6/2007 Mick et al.
2007/0158220 A1 7/2007 Cleereman et al.
2007/0215663 A1 9/2007 Chongson et al.
2007/0241012 A1 10/2007 Latchford et al.

(56) References Cited

U.S. PATENT DOCUMENTS

| | | | |
|---|---|---|---|
| 2007/0261976 | A1 | 11/2007 | Anderson |
| 2007/0261978 | A1 | 11/2007 | Sanderson |
| 2007/0280053 | A1 | 12/2007 | Polany et al. |
| 2007/0297149 | A1 | 12/2007 | Richardson et al. |
| 2008/0081679 | A1 | 4/2008 | Kawasaki et al. |
| 2008/0157485 | A1 | 7/2008 | Isono |
| 2008/0164267 | A1 | 7/2008 | Huber |
| 2009/0009945 | A1 | 1/2009 | Johnson et al. |
| 2009/0017884 | A1 | 1/2009 | Rotschild |
| 2009/0028535 | A1 | 1/2009 | Funahashi et al. |
| 2009/0032420 | A1 | 2/2009 | Zenzai |
| 2009/0034169 | A1 | 2/2009 | Richardson et al. |
| 2009/0087655 | A1 | 4/2009 | Yamada et al. |
| 2009/0090532 | A1 | 4/2009 | Lai et al. |
| 2009/0109635 | A1 | 4/2009 | Chen et al. |
| 2009/0117957 | A1 | 5/2009 | Araki et al. |
| 2009/0167545 | A1 | 7/2009 | Osaka |
| 2009/0211775 | A1 | 8/2009 | Yamaguchi et al. |
| 2009/0215412 | A1 | 8/2009 | Liu et al. |
| 2009/0260844 | A1 | 10/2009 | Tseng |
| 2010/0044198 | A1 | 2/2010 | Tang et al. |
| 2010/0085691 | A1 | 4/2010 | Yeh et al. |
| 2010/0093412 | A1 | 4/2010 | Serra et al. |
| 2010/0144194 | A1 | 6/2010 | Umei et al. |
| 2010/0147737 | A1 | 6/2010 | Richardson et al. |
| 2010/0181108 | A1 | 7/2010 | Hata et al. |
| 2010/0203931 | A1 | 8/2010 | Hynecek et al. |
| 2010/0206601 | A1 | 8/2010 | Choraku et al. |
| 2010/0238119 | A1 | 9/2010 | Dubrovsky et al. |
| 2010/0313485 | A1 | 12/2010 | Kuo |
| 2011/0017620 | A1 | 1/2011 | Latchford et al. |
| 2011/0024315 | A1 | 2/2011 | Kim |
| 2011/0228460 | A1 | 9/2011 | Kim et al. |
| 2012/0031914 | A1 | 2/2012 | Liu |
| 2012/0043235 | A1 | 2/2012 | Klement |
| 2012/0099261 | A1 | 4/2012 | Reber |
| 2012/0099262 | A1 | 4/2012 | Reber et al. |
| 2012/0099265 | A1 | 4/2012 | Reber |
| 2012/0099266 | A1 | 4/2012 | Reber et al. |
| 2012/0103844 | A1 | 5/2012 | Piedra et al. |
| 2012/0118773 | A1 | 5/2012 | Rayner |
| 2012/0168336 | A1 | 7/2012 | Schmidt et al. |
| 2012/0211382 | A1 | 8/2012 | Rayner |
| 2012/0314354 | A1 | 12/2012 | Rayner |
| 2013/0027862 | A1 | 1/2013 | Rayner |
| 2013/0077226 | A1 | 3/2013 | Rayner |
| 2013/0088130 | A1 | 4/2013 | Rayner |
| 2013/0220841 | A1 | 8/2013 | Yang |
| 2014/0262848 | A1 | 9/2014 | Fathollahi et al. |

FOREIGN PATENT DOCUMENTS

| | | | |
|---|---|---|---|
| JP | H0561069 | U | 8/1993 |
| JP | H0818637 | A | 6/1994 |
| JP | 2000341383 | A | 12/2000 |
| JP | 2003164316 | A | 6/2003 |
| WO | 9400037 | A1 | 1/1994 |
| WO | 0051315 | A1 | 8/2000 |
| WO | 0211161 | A2 | 2/2002 |
| WO | 2012074151 | A1 | 6/2012 |

SECTION C-C

WATERPROOF PROTECTIVE CASE FOR AN ELECTRONIC DEVICE

CROSS-REFERENCE TO RELATED APPLICATIONS

This application is a continuation of co-pending U.S. patent application Ser. No. 14/280,664, filed May 18, 2014, which in turn claims the benefit of U.S. Patent Application No. 61/824,991, filed May 18, 2013, each of which is hereby incorporated by reference in its entirety.

BACKGROUND

Personal electronic devices are often used for communication and entertainment purposes. Examples of personal electronic devices include smartphones, tablets, audio players, video players, cameras, portable computers, two-way radios, and GPS receivers. To protect an electronic device from damage resulting from everyday use, a protective case can be installed around the device.

BRIEF DESCRIPTIONS OF DRAWINGS

Figure 28:
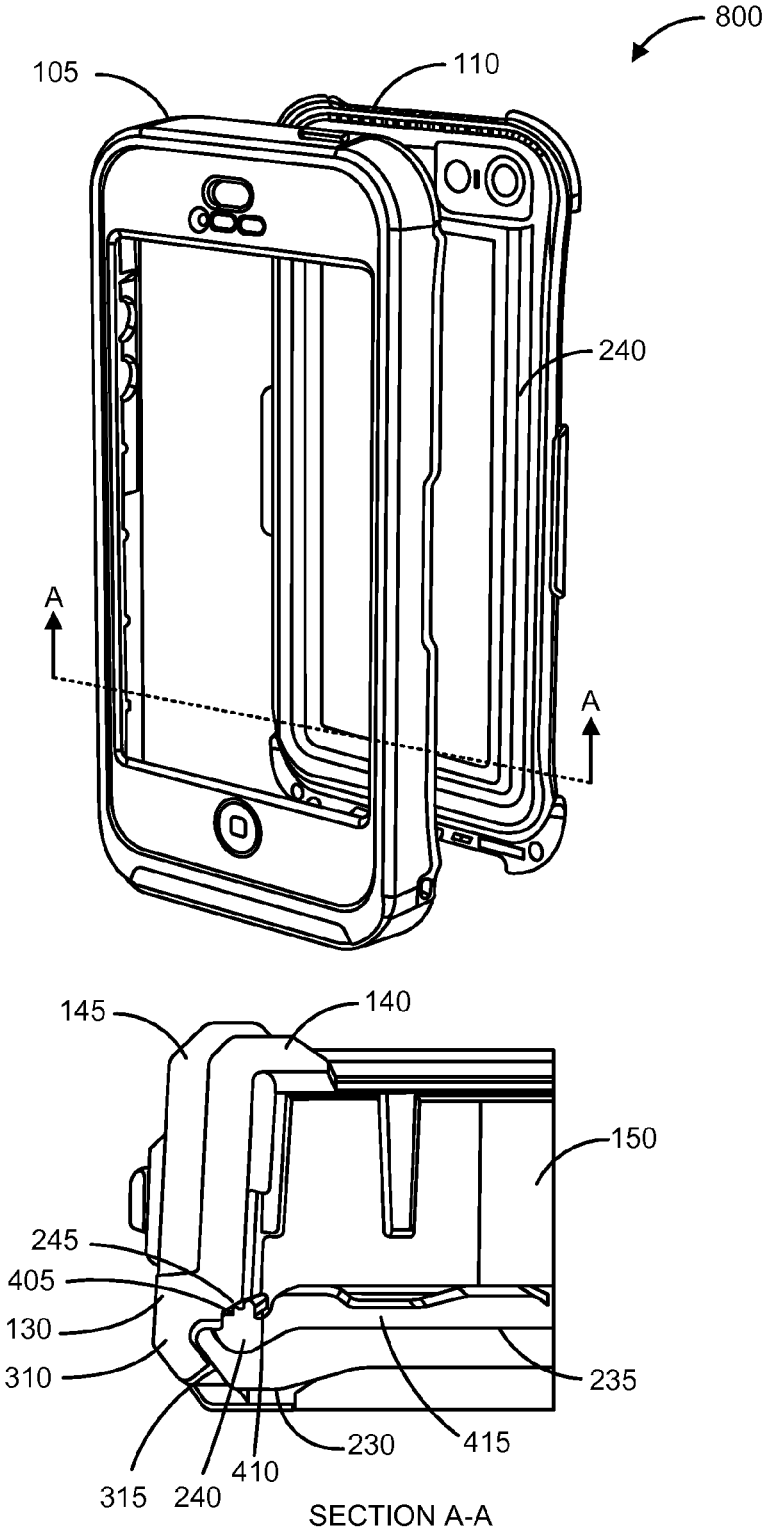

FIG. 28 includes an upper view and a lower view. The upper view shows a front perspective view of a second embodiment of a protective case for an electronic device in a disassembled state. The lower view shows a partial cross-sectional view of the second embodiment taken along Section A-A when the protective case is in an assembled state with the front portion connected to the back portion.

Figure 29:
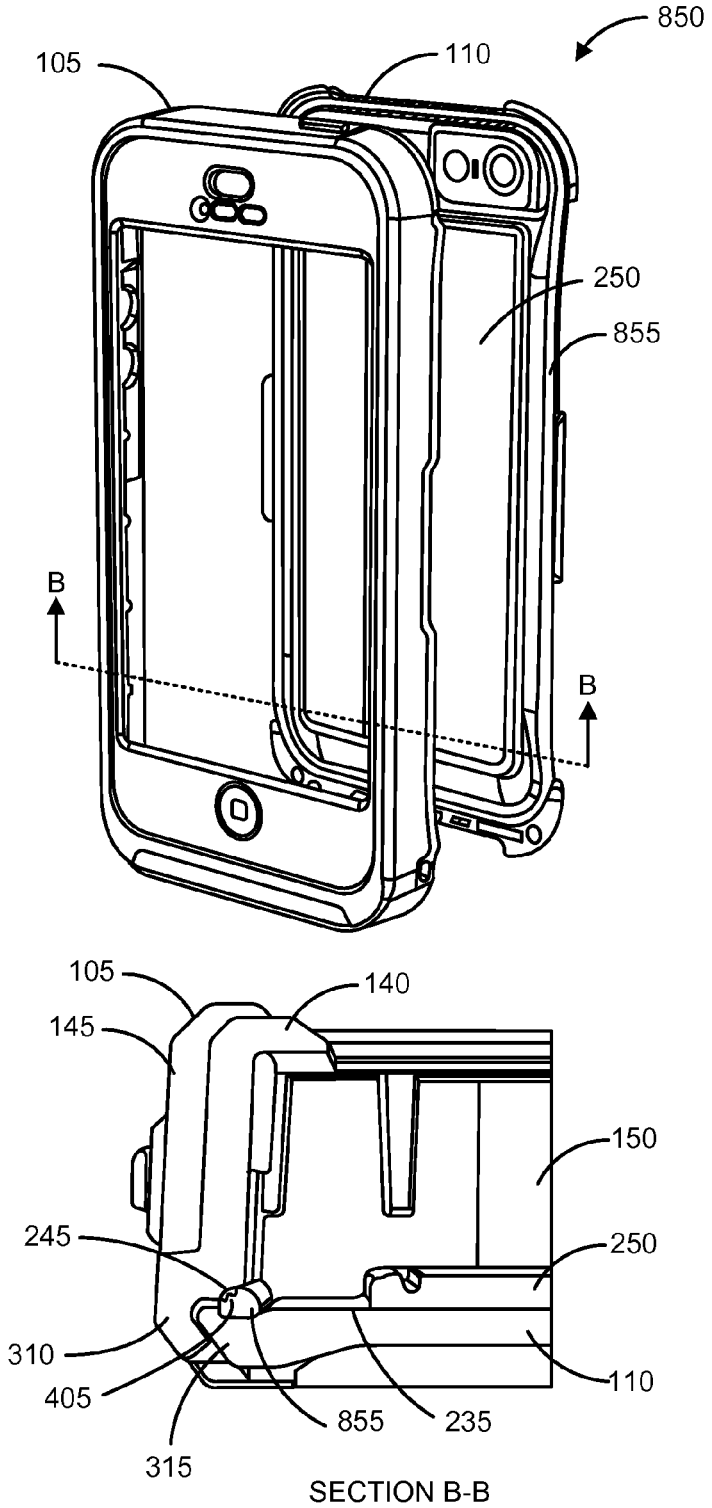

FIG. 29 includes an upper view and a lower view. The upper view shows a front perspective view of a third embodiment of a protective case for an electronic device in a disassembled state. The lower view shows a partial cross-sectional view of the third embodiment taken along Section B-B when the protective case is in an assembled state with the front portion connected to the back portion.

Figure 30:
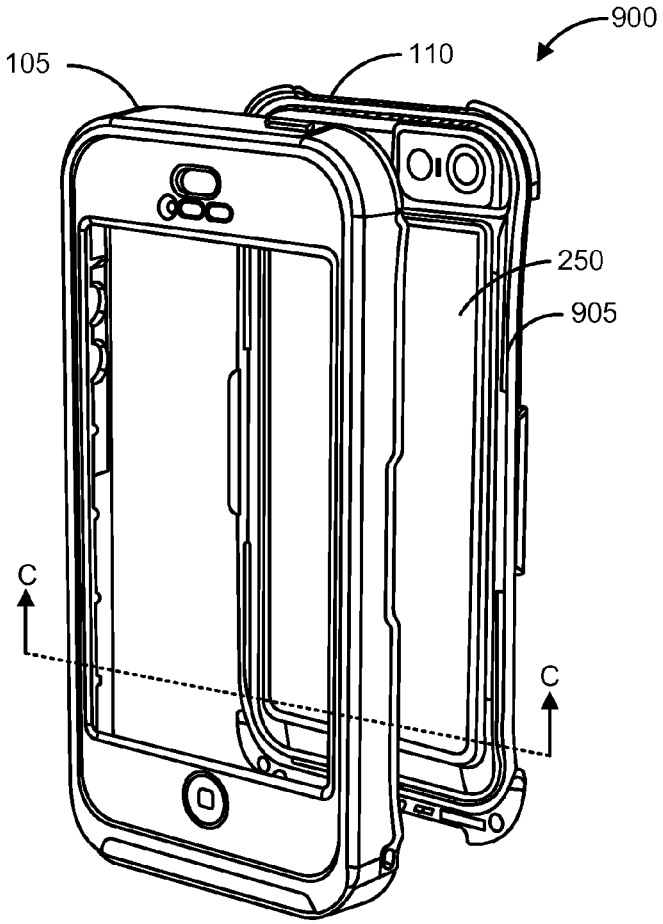
Figure 30:
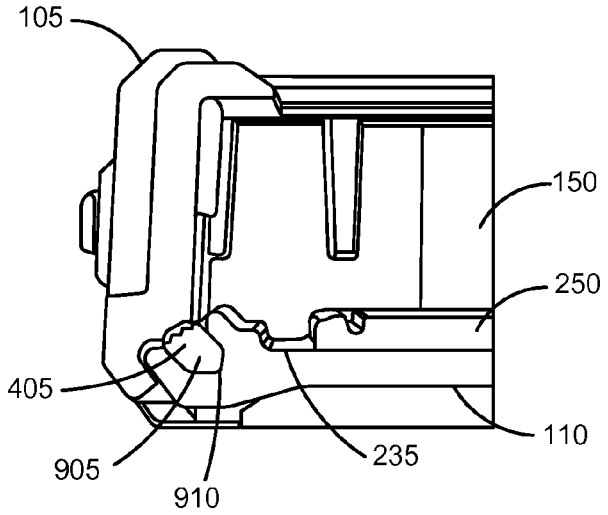

FIG. 30 includes an upper view and a lower view. The upper view shows a front perspective view of a fourth embodiment of a protective case for an electronic device in a disassembled state. The lower view shows a partial cross-sectional view of the fourth embodiment taken along Section C-C when the protective case is in an assembled state with the front portion connected to the back portion.

DETAILED DESCRIPTION

A protective case 100 for a personal electronic device, such as a smartphone, can include a front portion 105 and a back portion 110. The back portion 110 can attach to the front portion 105 to form a protective case 100. FIGS. 1-12 show the protective case 100 with the front portion 105 attached to the back portion 110, FIGS. 13-22 show the front portion 105 only, and FIGS. 23-27 show the back portion 110 only. In one example, the back portion 110 can attach to the front portion 105 to form a water-resistant protective case 100 that protects an electronic device from damage that would otherwise result from being dropped onto a hard surface from a moderate distance (e.g. dropping from a user's hand onto a tile or concrete surface) or exposure to liquids (e.g. submersion in a swimming pool or contact with a spilled beverage).

Figure 13:
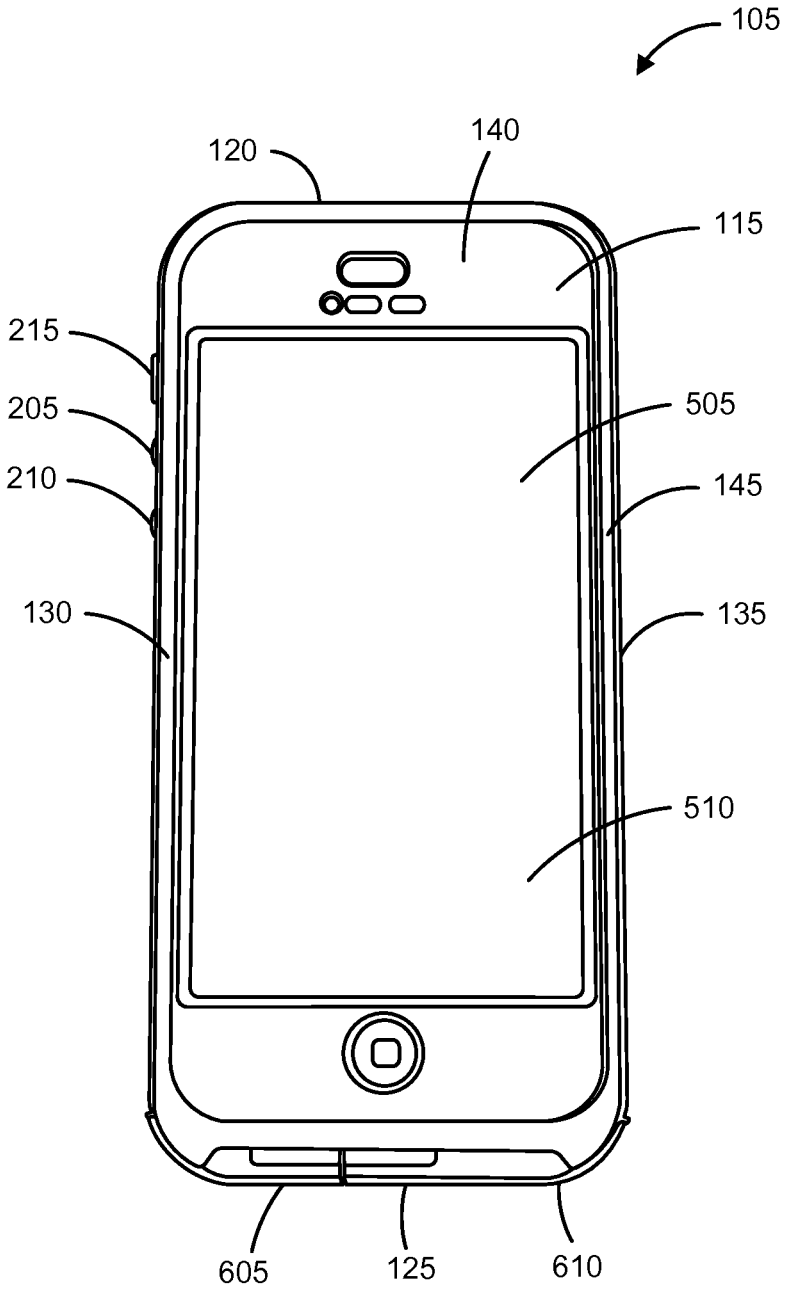
FIG. 13 is a front view of a front portion of the protective case of FIG. 1.
Figure 14:
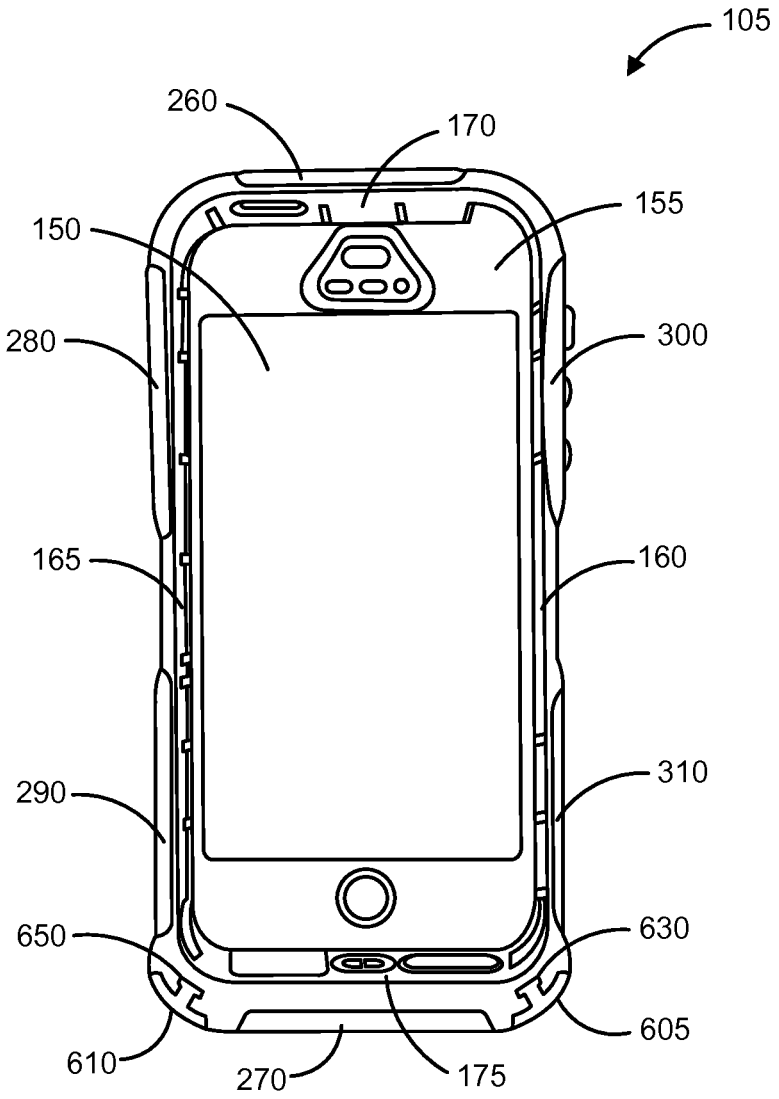
FIG. 14 is a back view of the front portion of the protective case of FIG. 1.

As shown in FIG. 13, the front portion 105 can have a front side surface 115, a top side surface 120, a bottom side surface 125, a left side surface 130, and a right side surface 135. As shown in FIG. 14, the back side of the front portion 105 can include a cavity 150 configured to receive a personal electronic device. The cavity 150 in the front portion 105 can be defined by an inner front side surface 155, an inner left side surface 160, an inner right side surface 165, an inner top side surface 170, and an inner bottom side surface 175.

The front portion 105 can include a front opening 505, as shown in FIG. 13. A transparent membrane 510 can be attached to the front portion 105 and can cover the front opening 505. The membrane 510 can be made of any suitable material that permits the user to interact with the display screen of the electronic device through the membrane 510. In one example, the membrane 510 can be made from a thin layer of thermoplastic polycarbonate (e.g. LEXAN), polyvinylchloride, high-strength alkali-aluminosilicate thin sheet glass (e.g. GORILLA GLASS), urethane, silicon, polyethylene terephthalate (PET), or any other suitable material. The membrane 510 can be formed using any suitable manufacturing process, such as thermoforming, casting, stretching, heating, or injection molding. In one example, the membrane 510 can include a thin, transparent, flexible layer of polyurethane, which can serve as a clear screen protector with desirable optical qualities (e.g. high transparency and low reflectivity). The membrane 510 can have any suitable thickness. In one example, the membrane 510 can have a thickness of about 0.001-0.100, 0.001-0.050, 0.004-0.020, 0.005-0.015, or 0.005-0.010 inches. The membrane 510 can have a micro-textured surface to reduce glare. The membrane 510 can include an oleophobic surface coating on its outer surface to minimize the appearance of fingerprints or oily smudges on the membrane, thereby allowing the screen of the electronic device to be clearly viewed through the membrane without unwanted obstructions.

The front portion 105 can include a first layer and a second layer. In one example, the second layer 145 can be overmolded onto the first layer 140. The first layer 140 can be made of a relatively hard material and the second layer 145 can be a relatively soft material. The first layer 140 can be made of any suitable material, including, but not limited to, polycarbonate (PC), high impact polystyrene (HIPS), nylon, fiberglass-filled nylon, acrylonitrile butadiene styrene (ABS), polyoxymethylene (POM), polyethylene terephthalate (PET), aluminum, aluminum alloy, titanium, wood, carbon fiber, or any combination thereof. The second layer 145 can be made of any suitable material, such as a thermoplastic elastomer. The first layer 140 can bolster the structural rigidity of the protective case 100 to enable the case to withstand a moderate drop (e.g. from a height of about 3-6 feet) without experiencing significant physical deformation upon impact, thereby ensuring that unwanted separation of the front portion 105 from the back portion 110 does not occur at impact. Separation of the front portion 105 from the back portion 110 (i.e. unwanted disassembly) is undesirable, since the electronic device will typically exit the cavity 150 of the front portion and then be unprotected and vulnerable to scratching or shattering as it makes direct contact with the ground.

The second layer 145 of the front portion 105 can be made of a relatively soft but durable material that dampens and dissipates impact energy associated with a moderate drop, thereby reducing the magnitude of shock forces transmitted to the electronic device housed inside the protective case 100 at a moment of impact and immediately thereafter.

The back portion 110 can be made of any suitable material, including, but not limited to, polycarbonate (PC), high impact polystyrene (HIPS), nylon, fiberglass-filled nylon, acrylonitrile butadiene styrene (ABS), polyoxymethylene (POM), polyethylene terephthalate (PET), aluminum, aluminum alloy, titanium, wood, carbon fiber, or any combination thereof. Similar to first layer 140 of the front portion 105, the back portion 110 can bolster the structural rigidity of the protective case 100 to enable the protective case to withstand a moderate drop (e.g. from a height of about 3-6 feet) without experiencing significant physical deformation upon impact, thereby ensuring that unwanted separation of the front portion 105 from the back portion does not occur at impact.

Figure 15:
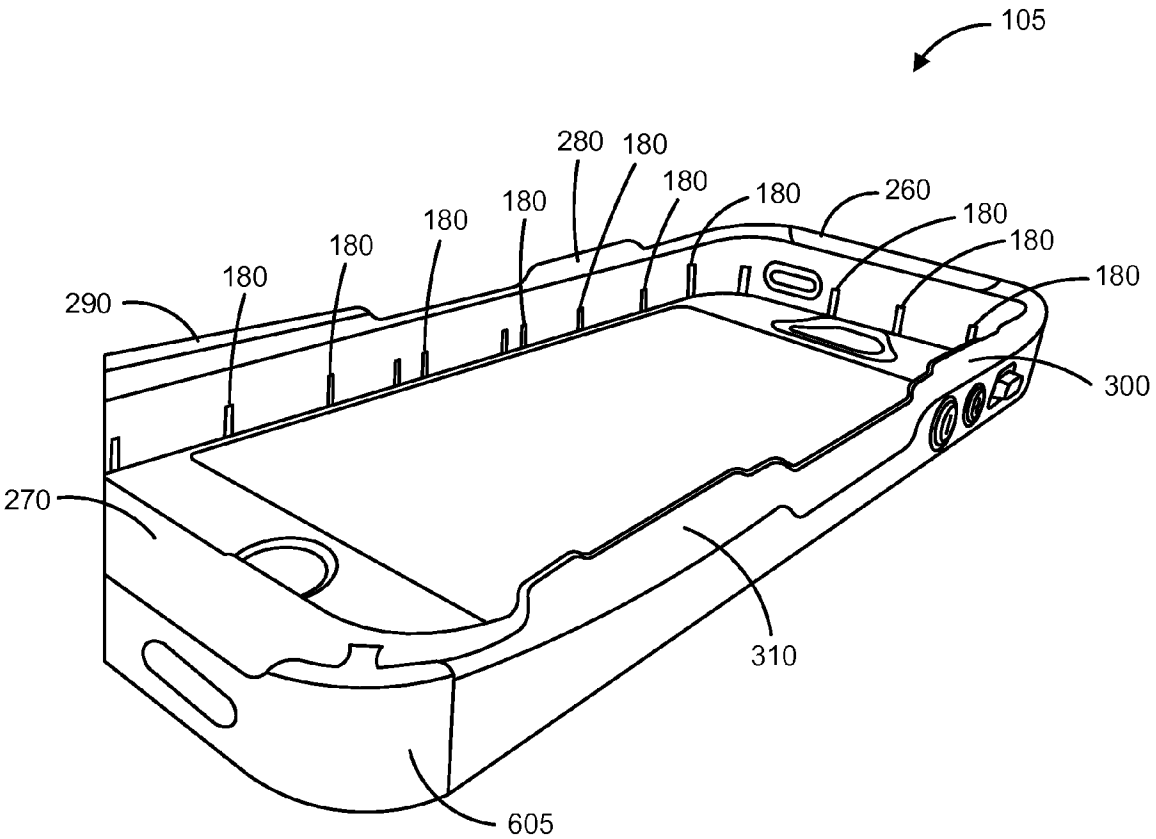
FIG. 15 is a partial back perspective view of the front portion of the protective case of FIG. 1.

The protective case 100 can include a plurality of relatively soft protrusions 180 on the inner surfaces of the cavity 150, as shown in FIG. 15. The protrusions 180 can improve the fit of the personal electronic device within the cavity 150. For instance, respective protrusions 180 can compress toward the inner surfaces (e.g. 160, 165, 170, and 175) of the cavity 150 when the electronic device is installed in the cavity, thereby taking up any gap between the device and the inner surfaces of the cavity 150. This permits the cavity 150 to be manufactured with a tolerance that is less restrictive than a tolerance that would be required if the cavity 150 were required to fit snugly around the device. This approach reduces manufacturing costs, since a higher percentage of manufactured front portions 110 will meet design specifications, thereby reducing the number of rejected parts and resultant waste. In addition to manufacturing considerations, the protrusions 180 serve a second important function; they isolate the electronic device from the inner surfaces of the cavity 150. As a result, an air gap is provided around the side surfaces of the electronic device. The air gaps prevent impact forces from being transmitted directly from the first layer 140 of the front portion 105 to the electronic device. The air gaps also prevent the side surfaces of the electronic device from becoming marred as a result of constant contact and minor positional shifting relative to the harder and less forgiving surfaces (e.g. 155, 160, 165, 170, 175) of the cavity 150 of the first layer 140 of the front portion 105. Consequently, the exterior condition of the electronic device is not degraded over time, which permits higher resale of the device when a user, for example, sells the device and upgrades to a newer model device.

Figure 17:
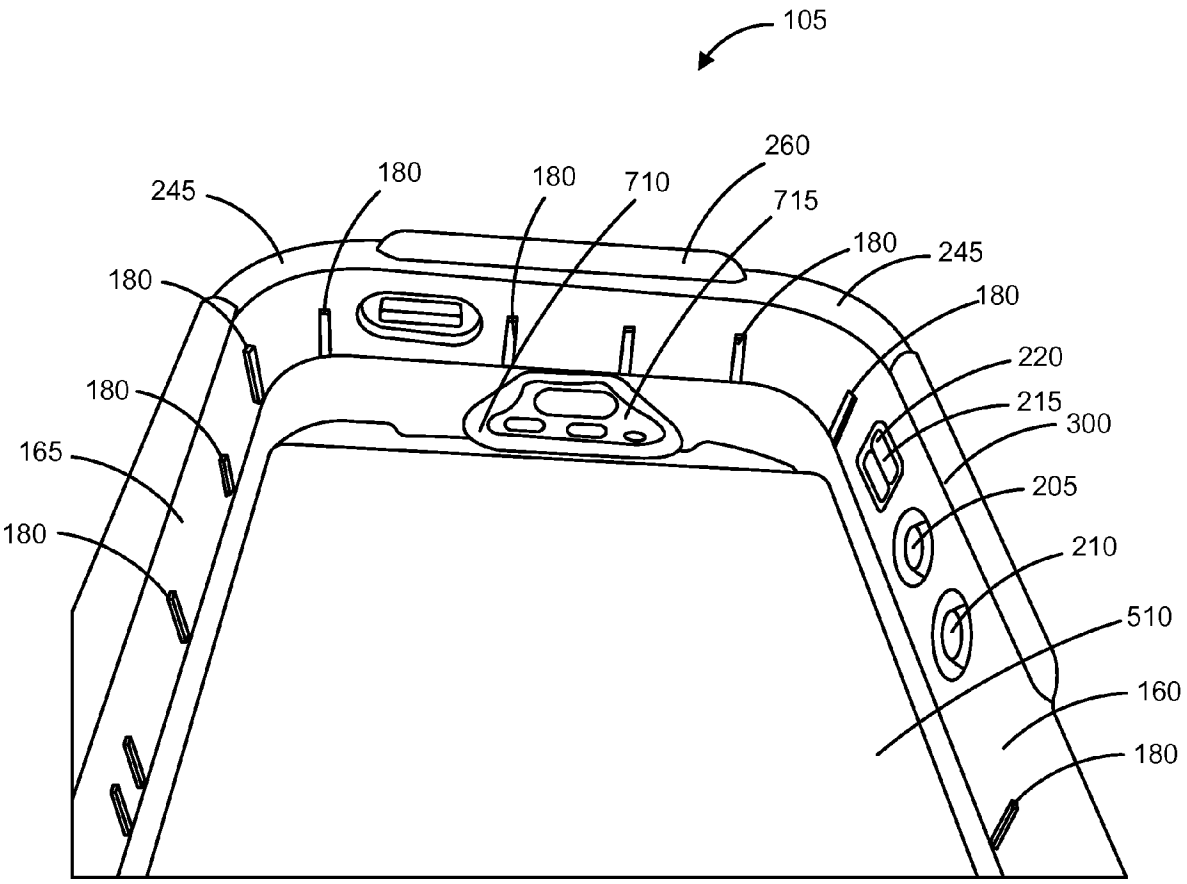
FIG. 17 is a partial back perspective view of an upper end of the front portion of the protective case of FIG. 1.
Figure 18:
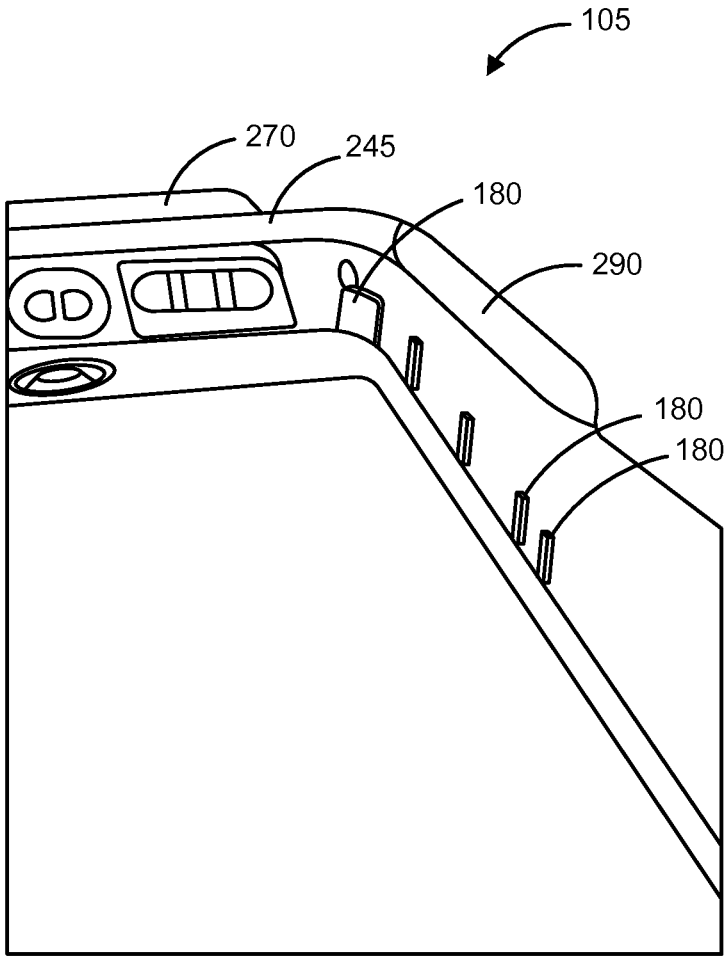
FIG. 18 is a partial back perspective view of the lower right corner of the front portion of the protective case of FIG. 1.
Figure 20:
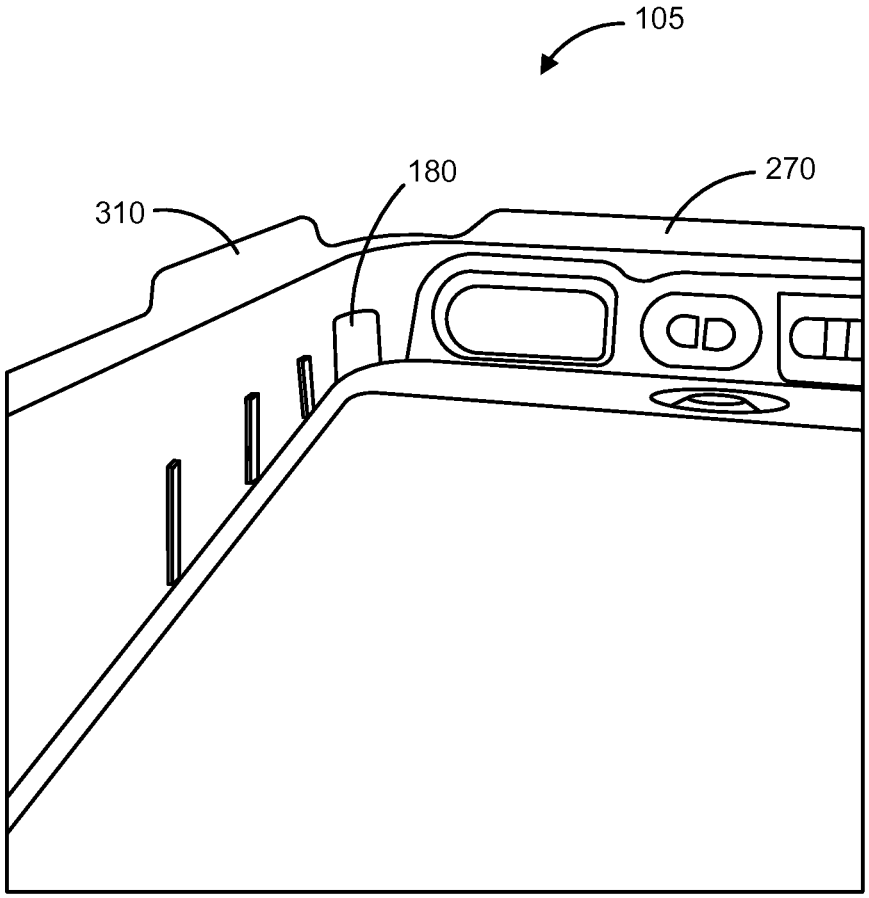
FIG. 20 is a partial back perspective view of a lower left corner of the front portion of the protective case of FIG. 1.
Figure 21:
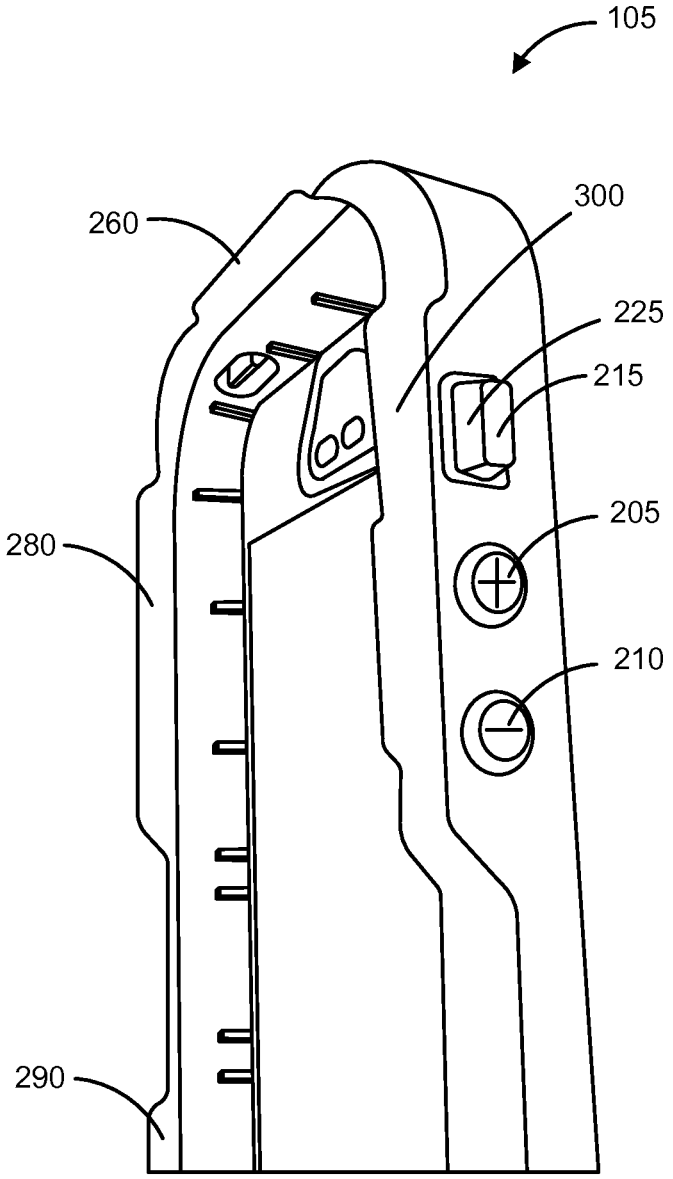
FIG. 21 is a partial back perspective view of the front portion of the protective case of FIG. 1.

As shown in FIG. 17, the inner left side surface 160 can include a plurality of protrusions 180 that extend inward toward the cavity 150 and can be configured to contact a left side surface of the electronic device. The inner right side surface 165 can include a plurality of protrusions 180 that extend inward toward the cavity 150 and that can be configured to contact a right side surface of the electronic device. The inner top side surface 170 can include a plurality of protrusions 180 that extend inward toward the cavity 150 and can be configured to contact a top side surface of the electronic device. As shown in FIGS. 18 and 20, the inner bottom side surface 175 can include a plurality of protrusions 180 that extend inward toward the cavity 150 and can be configured to contact a bottom side surface of the electronic device.

FIG. 17 shows a first button feature 205, a second button feature 210, and a third button feature 215. The first and second button features (205, 210) can be configured to engage a first volume button and a second volume button, respectively, on a left side surface of the electronic device. The front portion 105 can include openings in the first layer 140 to accommodate the first and second button features (205, 210), and the first and second button features can be formed in the second layer 145, as shown in FIGS. 17 and 20. The first and second button features (205, 210) can flex inward toward the cavity 150 when the user applies force to an outer surface of one of the button features, thereby permitting actuation of the respective button on the electronic device. The third button 215 feature can include a rocker switch feature configured to engage a rocker switch, such as a mute rocker switch, on the left side of the device. The rocker switch feature 115 can include an engagement feature 220 formed in the first layer 140, as shown in FIG. 17. The engagement feature 220 can be flexibly coupled to the front portion 105 by a flexible hinge 225. The flexible hinge 225 can be formed in the second layer 145. During manufacturing, thin gates can be formed to permit flow of the second layer 145 material to the engagement feature 220. The thin gates can then easily be broken by actuating the third button feature 215 during a first use. As a result, the engagement feature decouples entirely from the first layer 140 and resides only in the second layer 145, where it can easily be actuated by the user.

Figure 16:
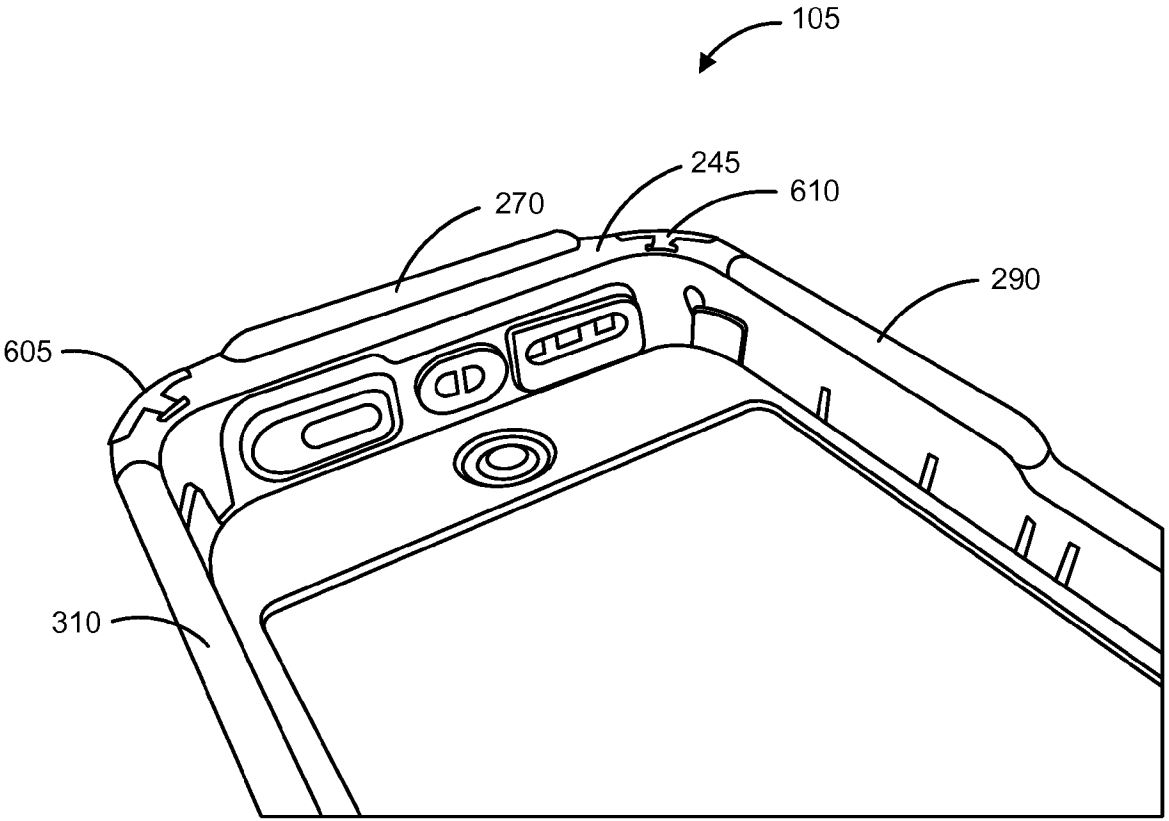
FIG. 16 is a partial back perspective view of a bottom end of the front portion of the protective case of FIG. 1.
Figure 24:
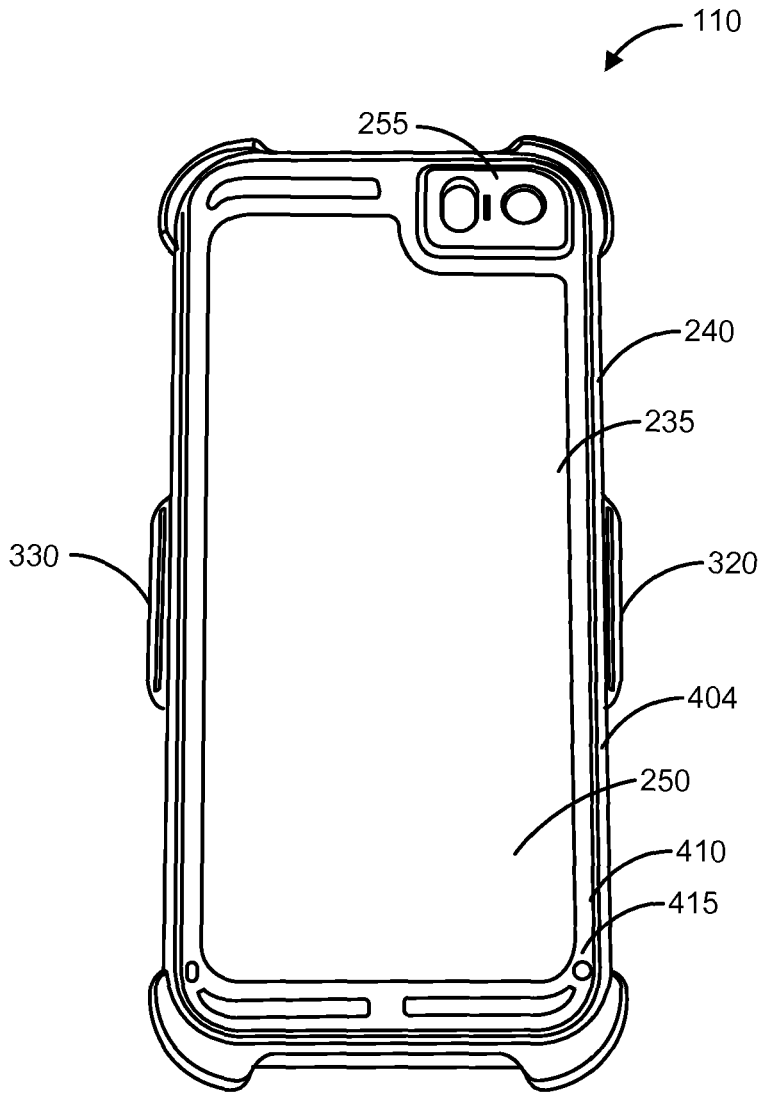
FIG. 24 is a front view of the back portion of the protective case of FIG. 1.

The back portion 110 can include an inner back surface 235 and an outer back surface 230. As shown in FIG. 24, the inner back surface 235 can include an overmolded gasket 240 extending around a perimeter of the back portion 110. The overmolded gasket 240 can establish a liquid-tight seal between the front portion 105 and the back portion 110 when the front and back portions are assembled to form a water-proof protective case 100. In one example, the overmolded gasket 240 can be made of a thermoplastic elastomer. As shown in FIGS. 16 and 17, the front portion 105 can include a mating surface 245 that is configured to mate against the overmolded gasket 240 when the back portion 110 is attached to the front portion 105. The seal formed between the overmolded gasket 240 and the mating surface 245 on the front portion 105 can be a water-resistant seal. During assembly of the front portion 105 to the back portion 100, the mating surface 245 can provide a compressive force against the overmolded gasket 240, thereby compressing the overmolded gasket 240 and ensuring a water-resistant seal.

Figure 26:
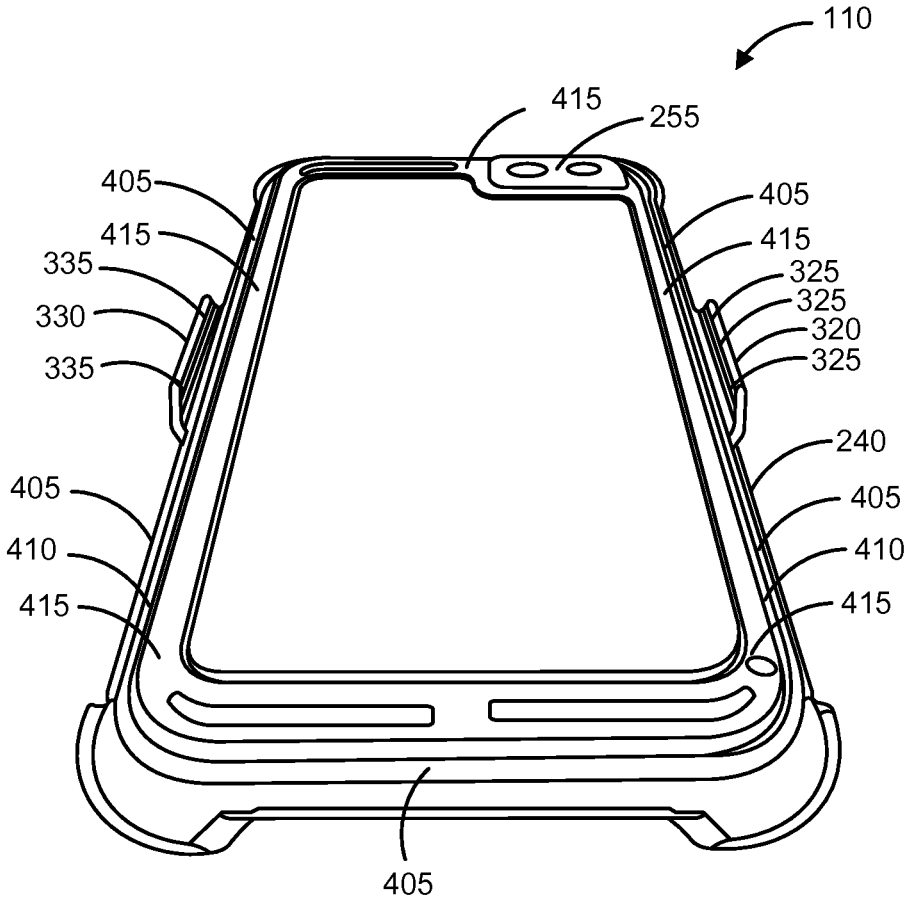
FIG. 26 is a front perspective view of the back portion of the protective case of FIG. 1.

The overmolded gasket 240 can include a flexible sealing surface 405 configured to mate against the sealing surface 245 of the front portion 105. As shown in FIG. 26, the overmolded gasket 240 can include a groove 410 located between the flexible sealing surface 405 and an inner gasket portion 415. The groove 410 can permit flexing of the flexible sealing surface 405 during assembly to provide a water-resistant seal between the flexible sealing surface and the sealing surface 245 of the front portion 105. The inner gasket portion 415 may not seal against the sealing surface of the front portion 105. Instead, the inner gasket portion 415 may improve manufacturability of the overmolded gasket. The inner gasket portion 415 can also enhance adhesion between the overmolded gasket 240 and the inner back surface 235 of the back portion 110 due to the greater contact area between the overmolded gasket and the inner back surface 235. Consequently, the inner gasket portion 415 can enhance durability and longevity of the overmolded gasket 240.

As shown in FIG. 24, the back portion 110 can include a foam layer 250 adhered to the inner back surface 235. The foam layer 250 can isolate the personal electronic device from the inner back surface 235 of the back portion 210. The foam layer 250 can provide impact protection by isolating the electronic device form the inner back surface 235 of the back portion 110, thereby preventing impact forces from being directly transmitted to the device. The foam layer 250 can be made of any suitable foam material. In some example, the foam layer 250 can be made of open cell foam or closed cell foam. In some examples, the foam layer 250 can be made of urethane foam or microcellular urethane foam, such as PORON.

As shown in FIG. 24, the back portion 110 can include a camera flash isolator 255. When the electronic device is installed in the protective case 100, the camera flash isolator 255 can be located between a camera and a flash on a back side surface of the electronic device. In one example, the camera flash isolator can include a foam layer adhered to an inner back surface 235 of the back portion 110. The foam layer can provide a light barrier between the camera and the flash and can extend from a back side surface of the electronic device to the inner back surface 235 of the back portion 110. When a user takes a flash photo with the electronic device, the camera flash isolator 255 can prevent light emitted from the flash from reflecting off of the inner back surface 235 of the back portion 110 toward the camera, where the reflected light would result in unwanted artifacts (e.g. aberrations) or blurriness in the photo image captured by the device.

Figure 4:
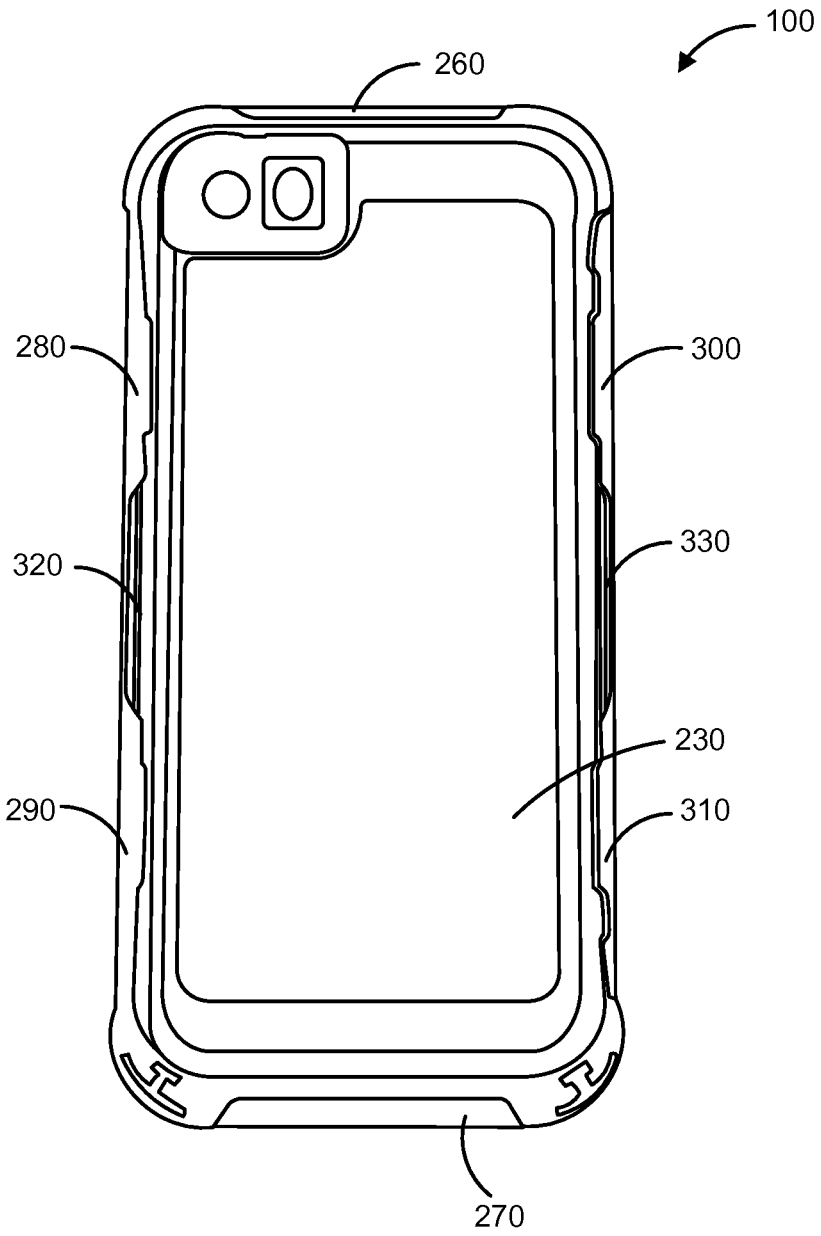
FIG. 4 is a back view of the protective case of FIG. 1.
Figure 9:
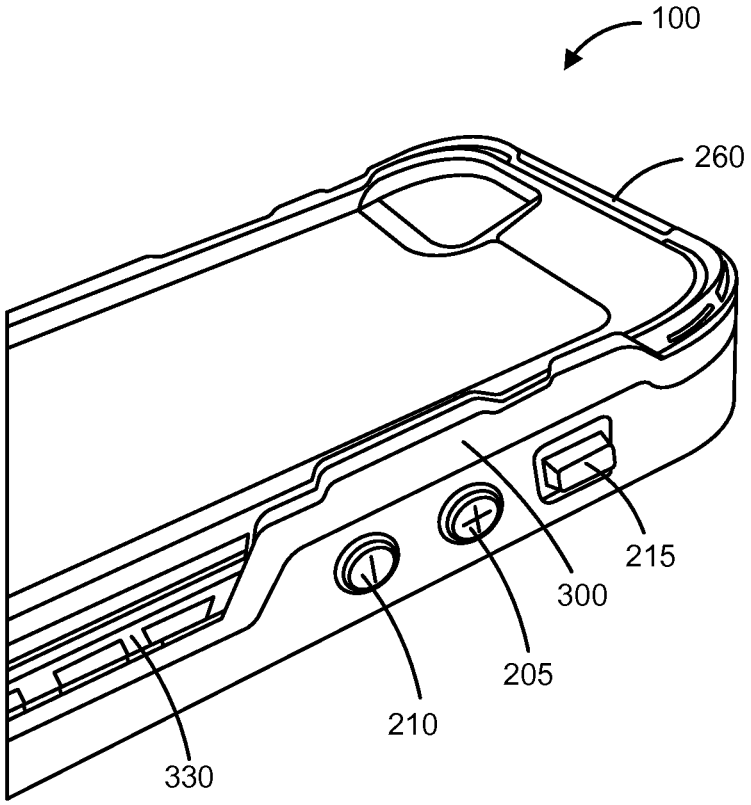
FIG. 9 is a partial back perspective view of the protective case of FIG. 1.
Figure 10:
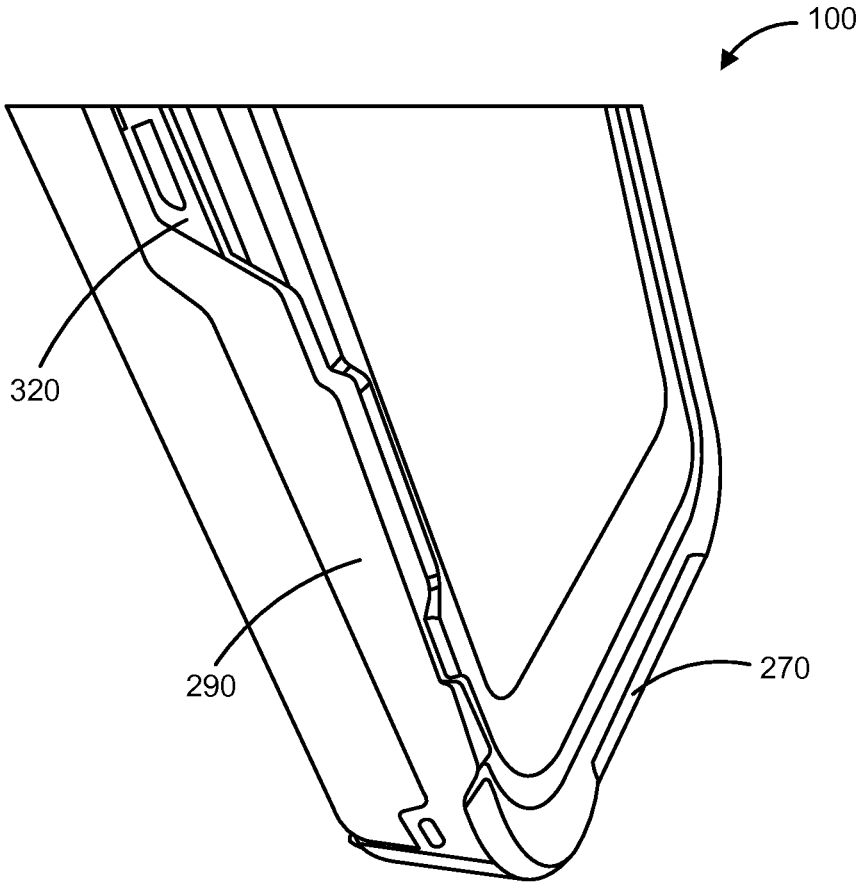
FIG. 10 is a partial back perspective view of the protective case of FIG. 1.
Figure 22:
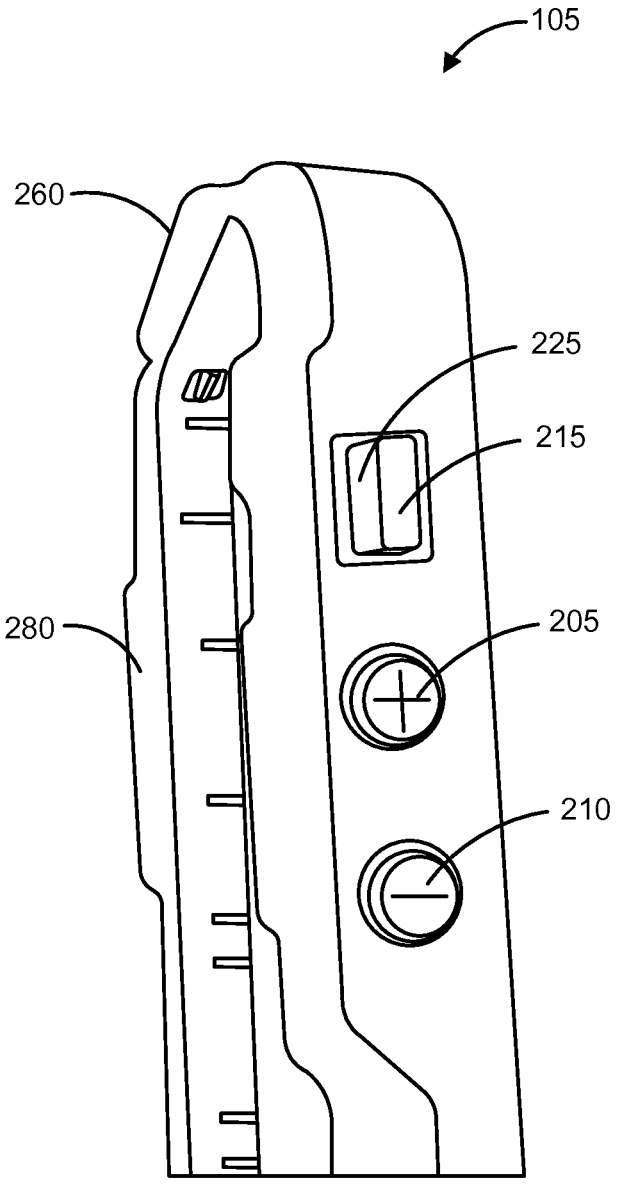
FIG. 22 is a partial back perspective view of the front portion of the protective case of FIG. 1.
Figure 23:
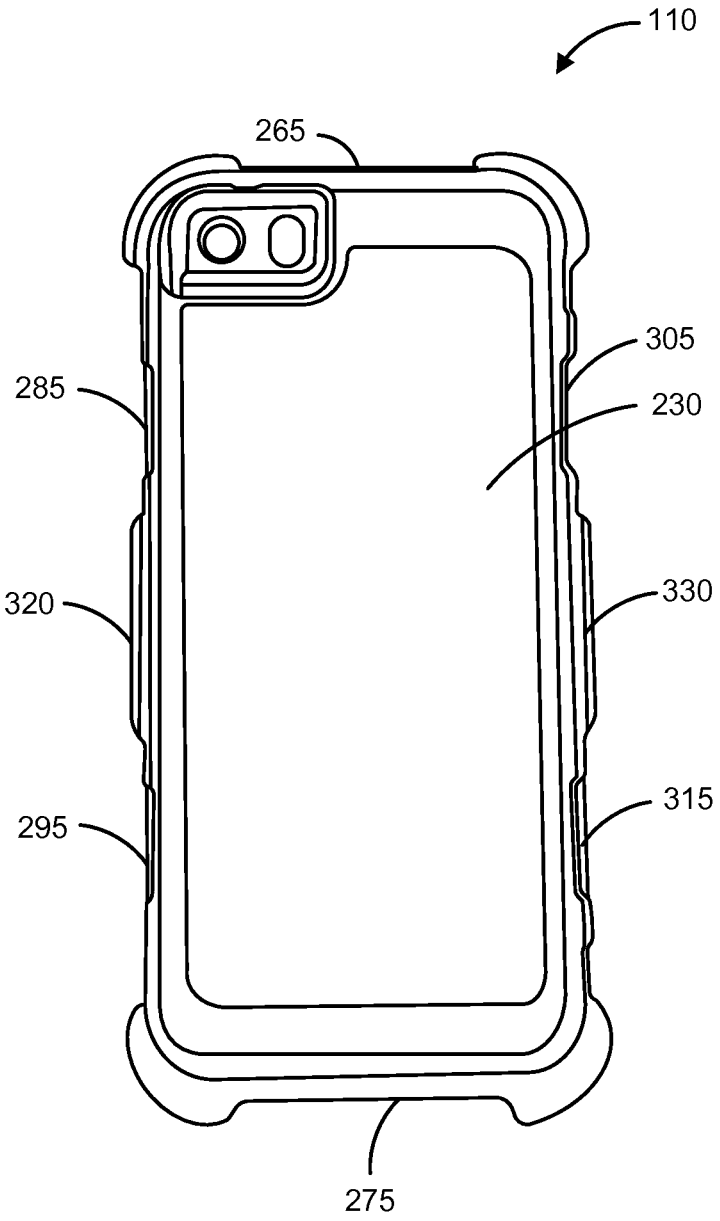
FIG. 23 is a back view of the back portion of the protective case of FIG. 1.
Figure 25:
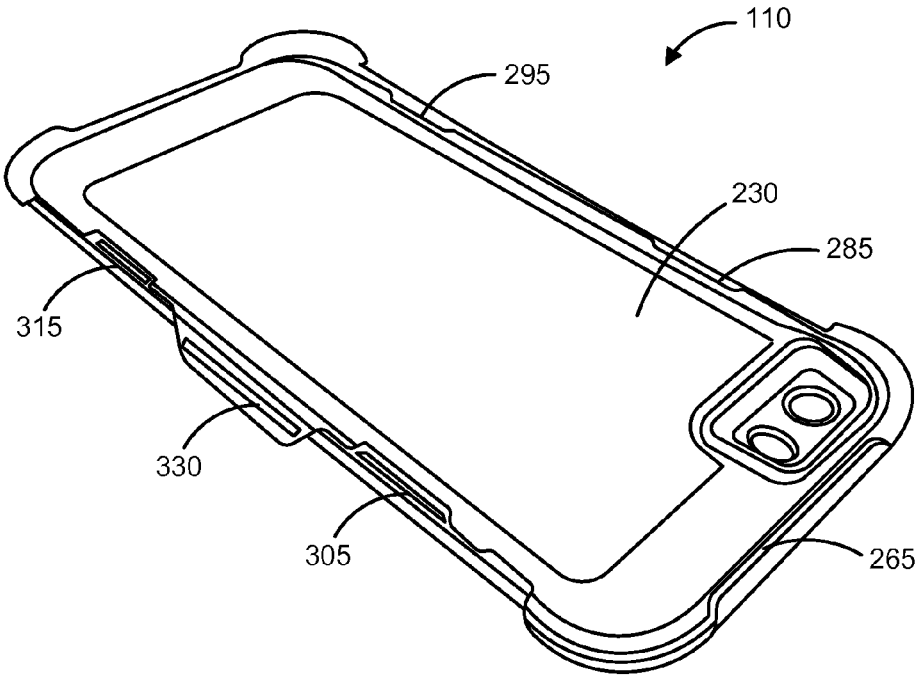
FIG. 25 is a back perspective view of the back portion of the protective case of FIG. 1.

As shown in FIGS. 17 and 22, the front portion 105 can include a top side clasping feature 260 extending from the top side surface 120. The back portion 110 can include a first clasping surface 265 on the back side surface 230, as shown in FIGS. 23 and 25. The top side clasping feature 260 can engage the first clasping surface 265, as shown in FIGS. 4 and 9. The first clasping surface 265 can be oriented at an angle of approximately 30-60, 40-50, or 45 degrees inward with respect to a first plane that is coplanar with the top side surface 120 of the front portion 105 when the front portion is attached to the back portion 110.

Figure 1:
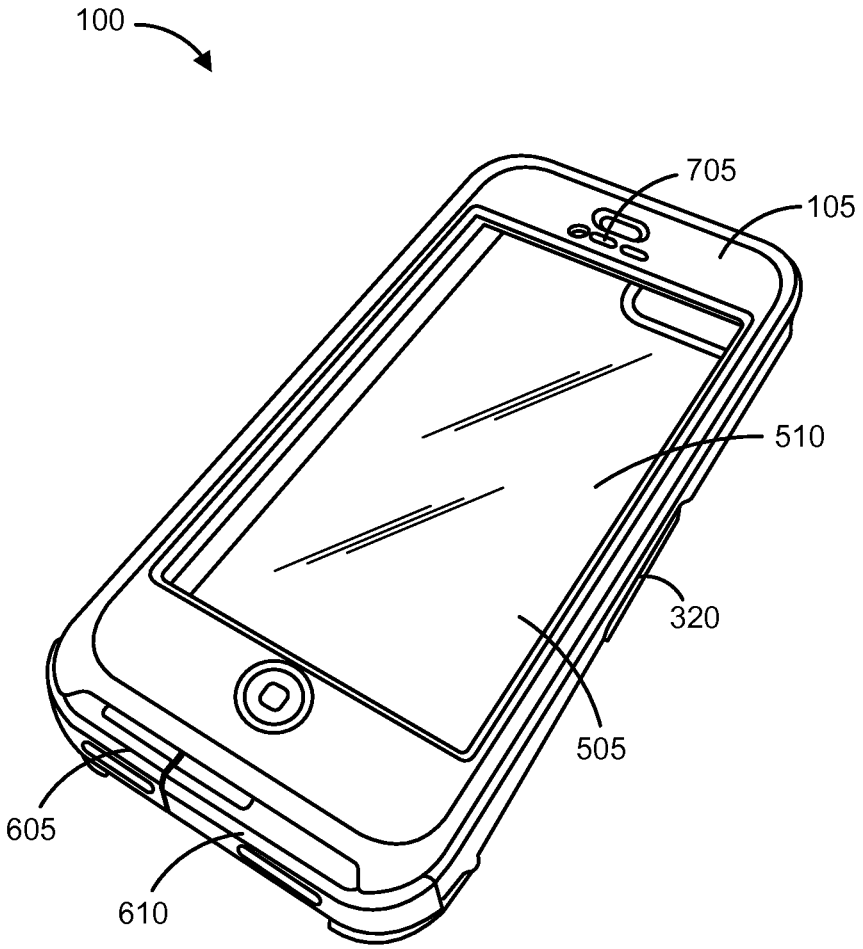
FIG. 1 is a front perspective view of a first embodiment of a protective case for an electronic device.
Figure 2:
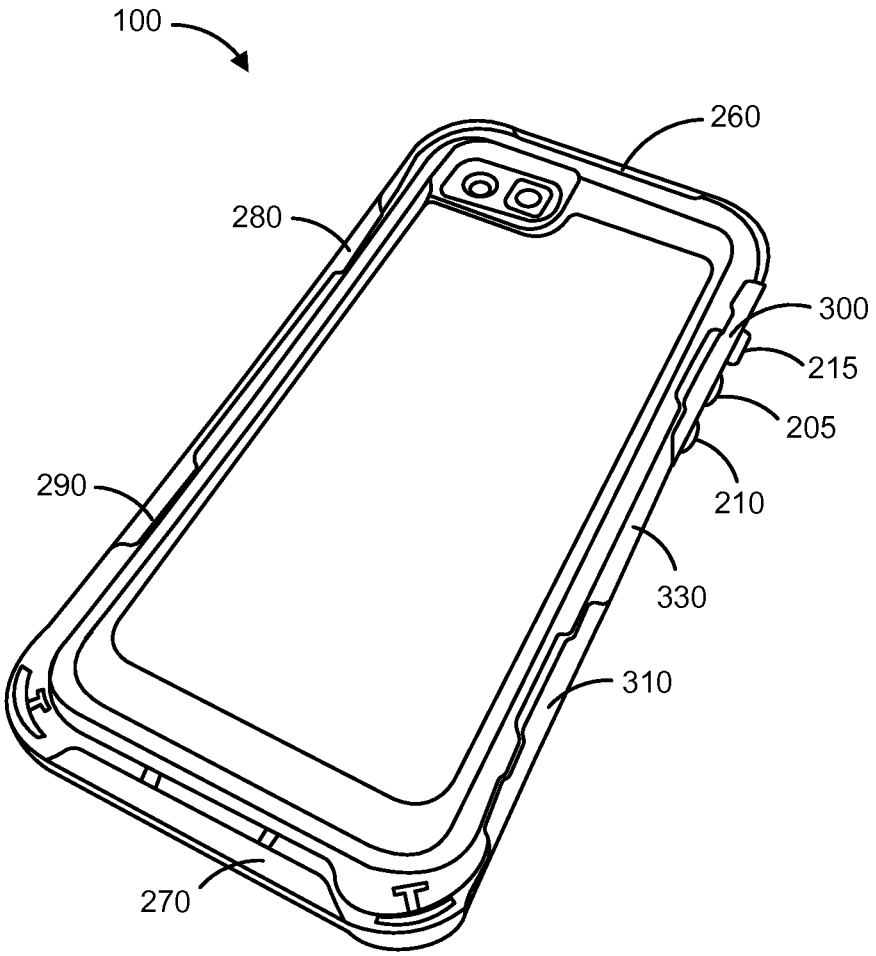
FIG. 2 is a back perspective view of the protective case of FIG. 1.
Figure 11:
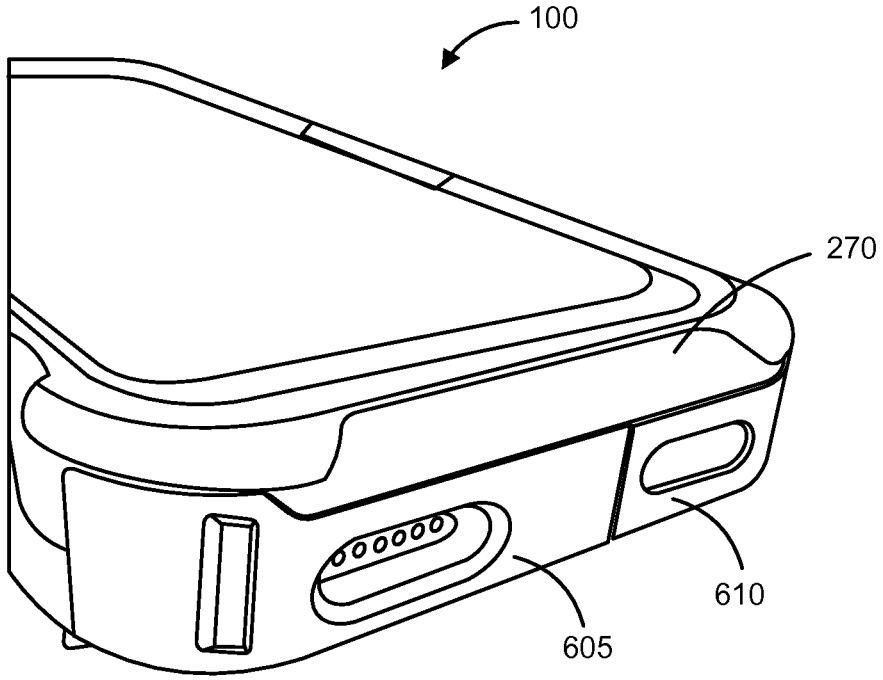
FIG. 11 is a partial bottom perspective view of the protective case of FIG. 1.
Figure 27:
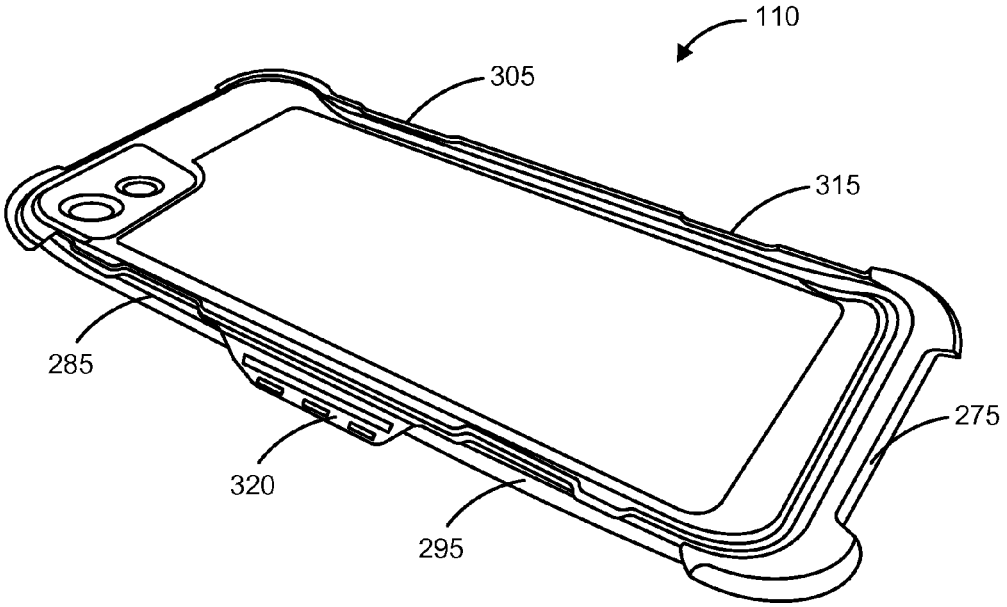
FIG. 27 is a back perspective view of the back portion of the protective case of FIG. 1.

As shown in FIGS. 14-16 and 18, the front portion 105 can include a bottom side clasping feature 270 extending from the bottom side surface 125. The back portion 110 can include a second clasping surface 275 on the back side surface 230, as shown in FIGS. 23 and 27. The bottom side clasping feature 270 can engage the second clasping surface 275, as shown in FIGS. 2, 4, and 11. The second clasping surface 275 can be oriented at an angle of approximately 30-60, 40-50, or 45 degrees inward with respect to a second plane that is coplanar with the bottom side surface 125 of the front portion 105 when the front portion is attached to the back portion 110.

Figure 12:
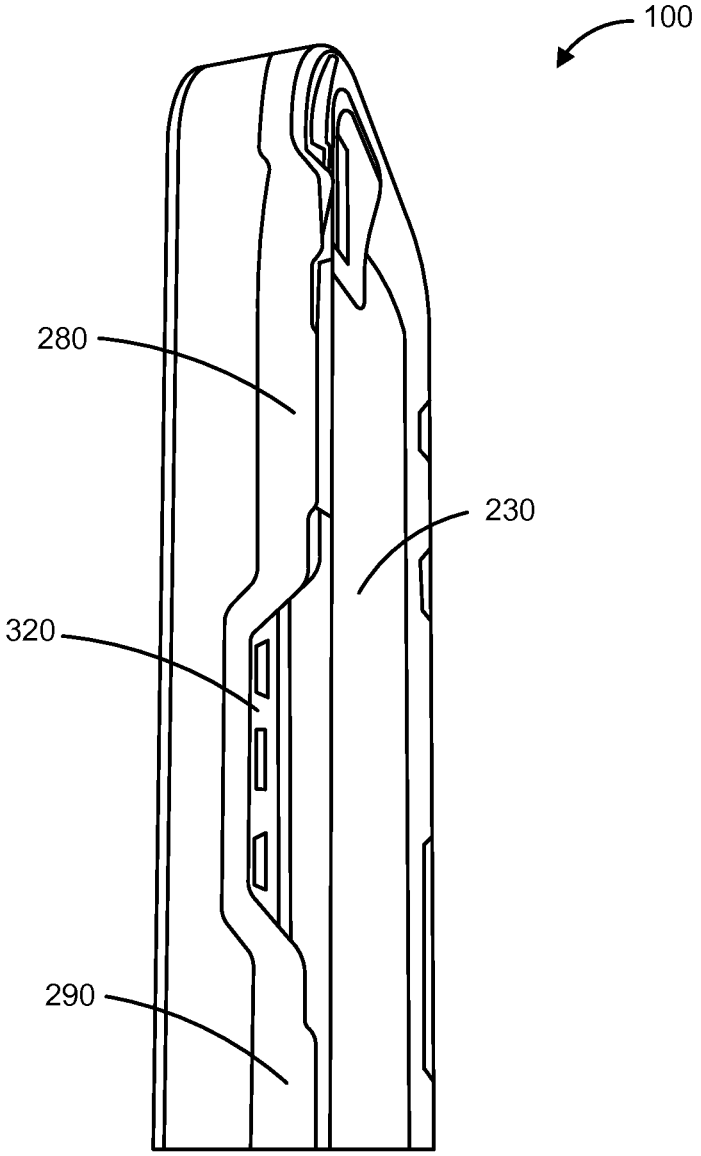
FIG. 12 is a partial right side rear perspective view of the protective case of FIG. 1.
Figure 19:
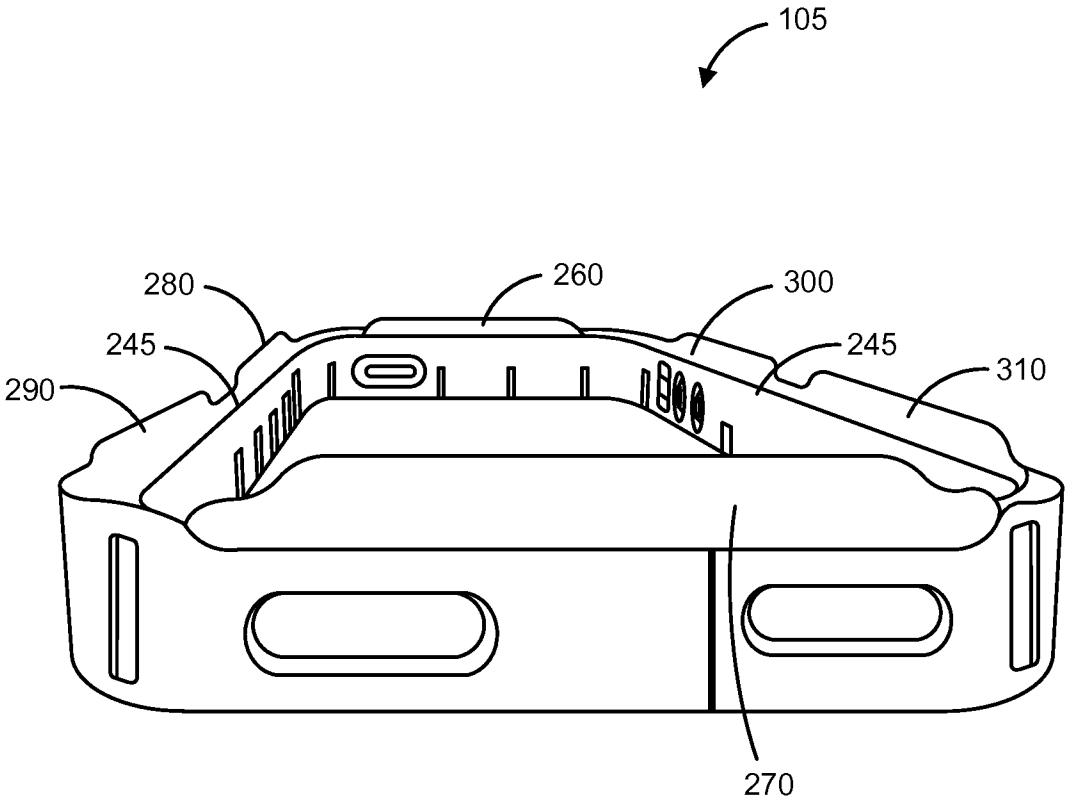
FIG. 19 is a bottom perspective view of the front portion of the protective case of FIG. 1.

As shown in FIGS. 14 and 19, the front portion 105 can include a first right side clasping feature 280 extending from the right side surface 135. The back portion 110 can include a third clasping surface 285 on the back side surface 230, as shown in FIGS. 23 and 27. The first right side clasping feature 280 can engage the third clasping surface 285, as shown in FIGS. 4 and 12. The third clasping surface 285 can be oriented at an angle of approximately 30-60, 40-50, or 45 degrees inward with respect to a third plane that is coplanar with the right side surface 135 of the front portion 105 when the front portion is attached to the back portion 110.

As shown in FIGS. 14 and 19, the front portion 105 can include a second right side clasping feature 290 extending from the right side surface 135. The back portion 110 can include a fourth clasping surface 295 on the back side surface 230, as shown in FIGS. 23 and 27. The second right side clasping feature 290 can engage the fourth clasping surface 295, as shown in FIGS. 4 and 12. The fourth clasping surface 295 can be oriented at an angle of approximately 30-60, 40-50, or 45 degrees inward with respect to the third plane that is coplanar with the right side surface 135 of the front portion 105 when the front portion is attached to the back portion 110.

As shown in FIGS. 14 and 17, the front portion 105 can include a first left side clasping feature 300 extending from the left side surface 130. The back portion 110 can include a fifth clasping surface 305 on the back side surface 230, as shown in FIGS. 23 and 25. The first left side clasping feature 300 can engage the fifth clasping surface 305, as shown in FIGS. 4 and 9. The fifth clasping surface 305 can be oriented at an angle of approximately 30-60, 40-50, or 45 degrees inward with respect to a fourth plane that is coplanar with the left side surface 130 of the front portion 105 when the front portion is attached to the back portion 110.

As shown in FIGS. 14 and 15, the front portion 105 can include a second left side clasping feature 310 extending from the left side surface 130. The back portion 110 can include a sixth clasping surface 315 on the back side surface 230, as shown in FIGS. 23 and 25. The second left side clasping feature 310 can engage the sixth clasping surface 315, as shown in FIG. 4. The sixth clasping surface 315 can be oriented at an angle of approximately 30-60, 40-50, or 45 degrees inward with respect to the fourth plane that is coplanar with the left side surface 130 of the front portion 105 when the front portion is attached to the back portion 110.

The back portion 110 can include a right side retention feature 320 extending from a right side edge of the back portion, as shown in FIG. 12. The right side retention feature 320 can be oriented at an angle of approximately 90 degrees with respect to a fifth plane that is coplanar with the outer back surface 230 of the back portion 110. The right side retention feature 320 can include an outer surface and an inner surface opposite the inner surface. The right side retention feature 320 can include one or more detents 325, as shown in FIG. 26, extending from the inner surface toward the cavity 150 when the front portion 105 is attached to the back portion 110. The front portion 105 can include one or more recesses on the right side surface 135, and the recesses can be configured to receive the one or more detents when the front portion is attached to the back portion 110.

The back portion 110 can include a left side retention feature 330 extending from a left side edge of the back portion, as shown in FIGS. 4 and 9. The left side retention feature 330 can be oriented at an angle of approximately 90 degrees with respect to the fifth plane that is coplanar with the outer back surface 230 of the back portion 110. The right side retention feature 330 can include an outer surface and an inner surface opposite the inner surface. The left side retention feature 330 can include one or more detents 335, as shown in FIG. 26, extending from the inner surface toward the cavity 150 when the front portion 105 is attached to the back portion 110. The front portion 105 can include one or more recesses on the left side surface 130, and the one or more recesses can be configured to receive the one or more detents 335 when the front portion is attached to the back portion 110.

Figure 5:
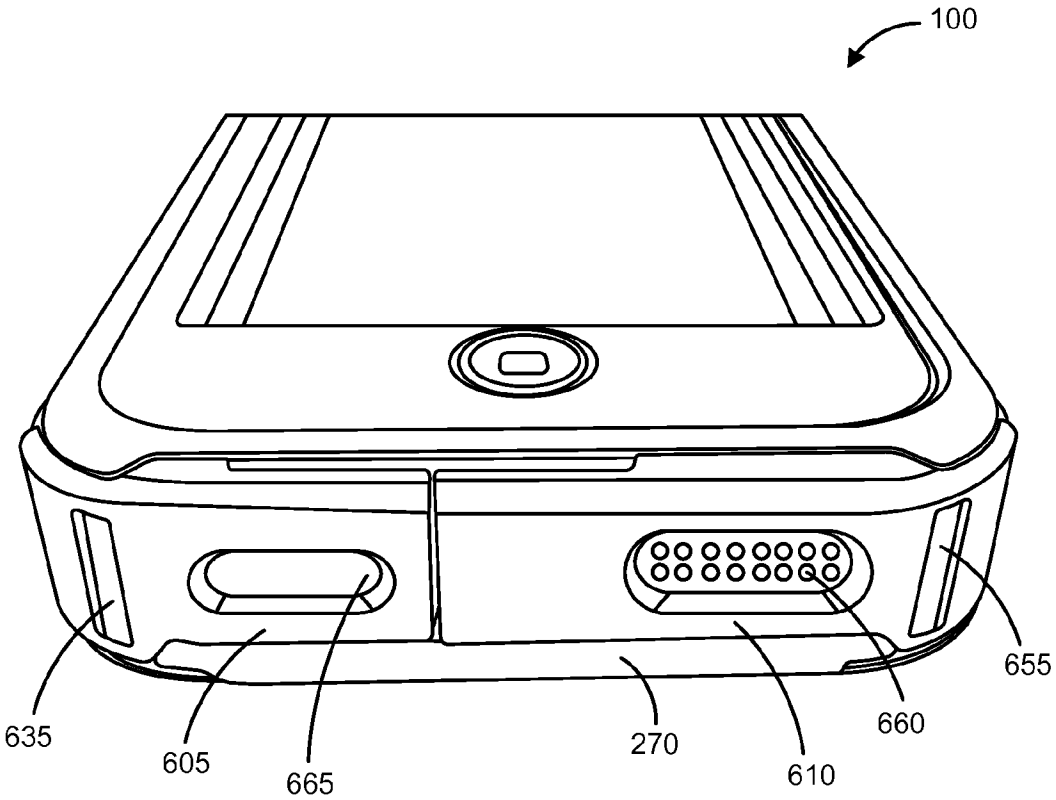
FIG. 5 is a bottom perspective view of the protective case of FIG. 1.
Figure 6:
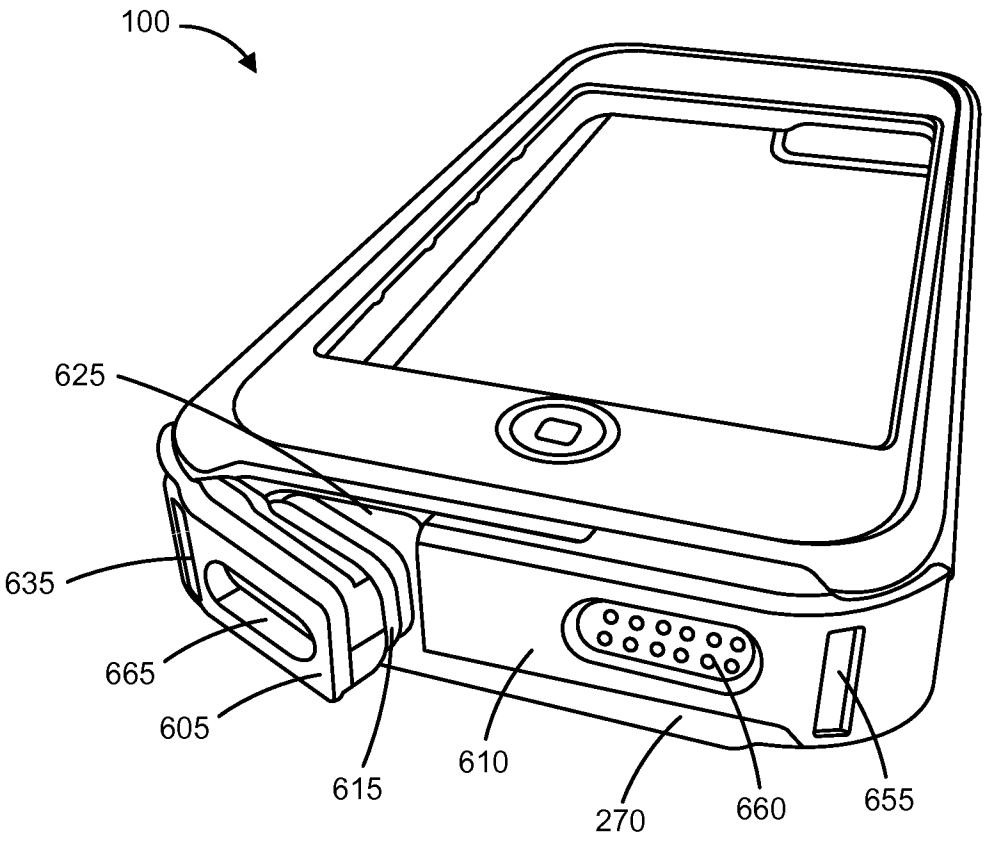
FIG. 6 is a bottom perspective view of the protective case of FIG. 1 showing a first port cover in a partially open position.

The front portion 105 can include a first port cover 605 flexibly attached to the bottom side 125 of the front portion, as shown in FIGS. 5 and 13. The first port cover 605 can be configured to cover and seal a first port opening 625 in the bottom side of the front portion 105, as shown in FIG. 6. The first port cover 605 can include a first O-ring 615 configured to seal against an inner surface of the first port opening 625 to provide a water-resistant seal when the first port cover is in a closed position. When in an open position, the first port cover 605 can provide access to features of the personal electronic device through the first port opening 625. In one example, the first port cover 605 can be attached to the front portion 105 by inserting a feature of the first port cover into a slot 630 in the front portion, as shown in FIG. 14. The first port cover 605 can include a first hinge 635, as shown in FIG. 5, to permit flexing of the first port cover during opening and closing. In one example, the first hinge 635 can be a portion of the first port cover 605 having a relatively thinner cross-sectional area than adjacent portions of the port cover. When the first port cover 605 is in a closed position, it can permit sound to pass through the first port opening 625. In one example, the first port cover 605 can include an opening 665 that is covered with an acoustic membrane (e.g. an acoustic membrane made of GORE-TEX) that permits sound transmission.

Figure 7:
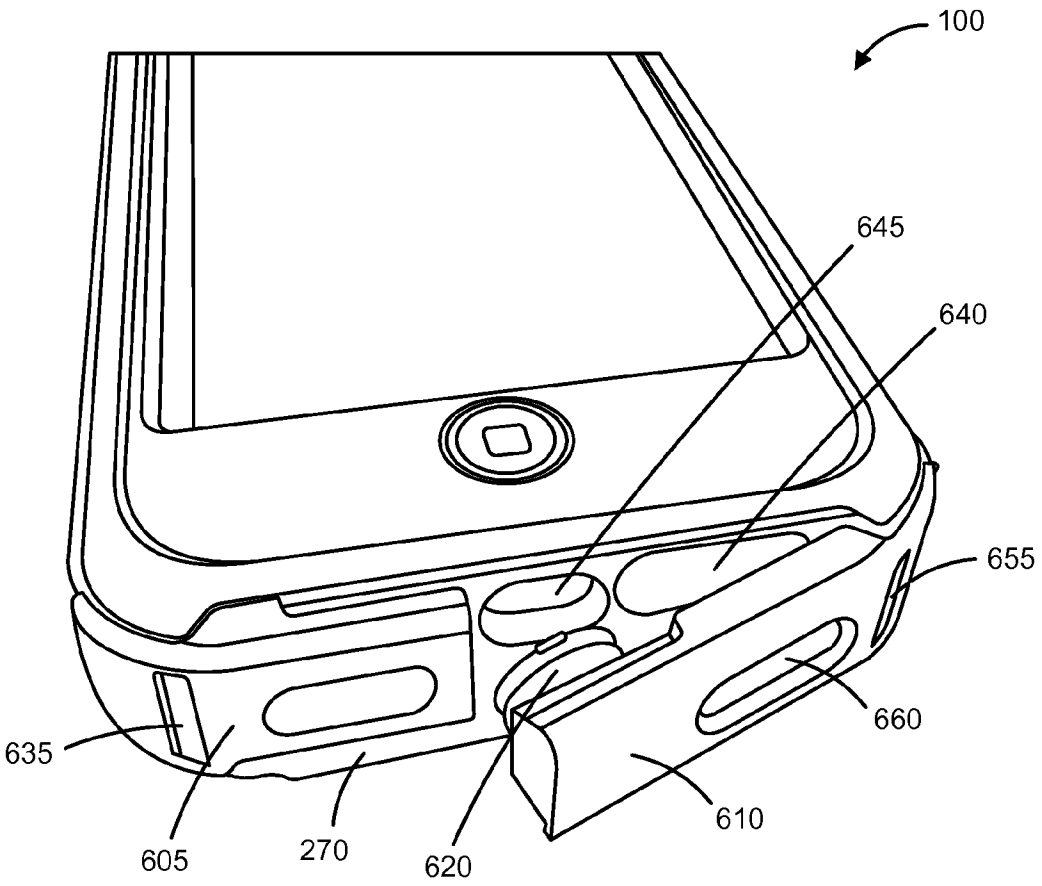
FIG. 7 is a bottom perspective view of the protective case of FIG. 1 showing a second port cover in a partially open position.
Figure 8:
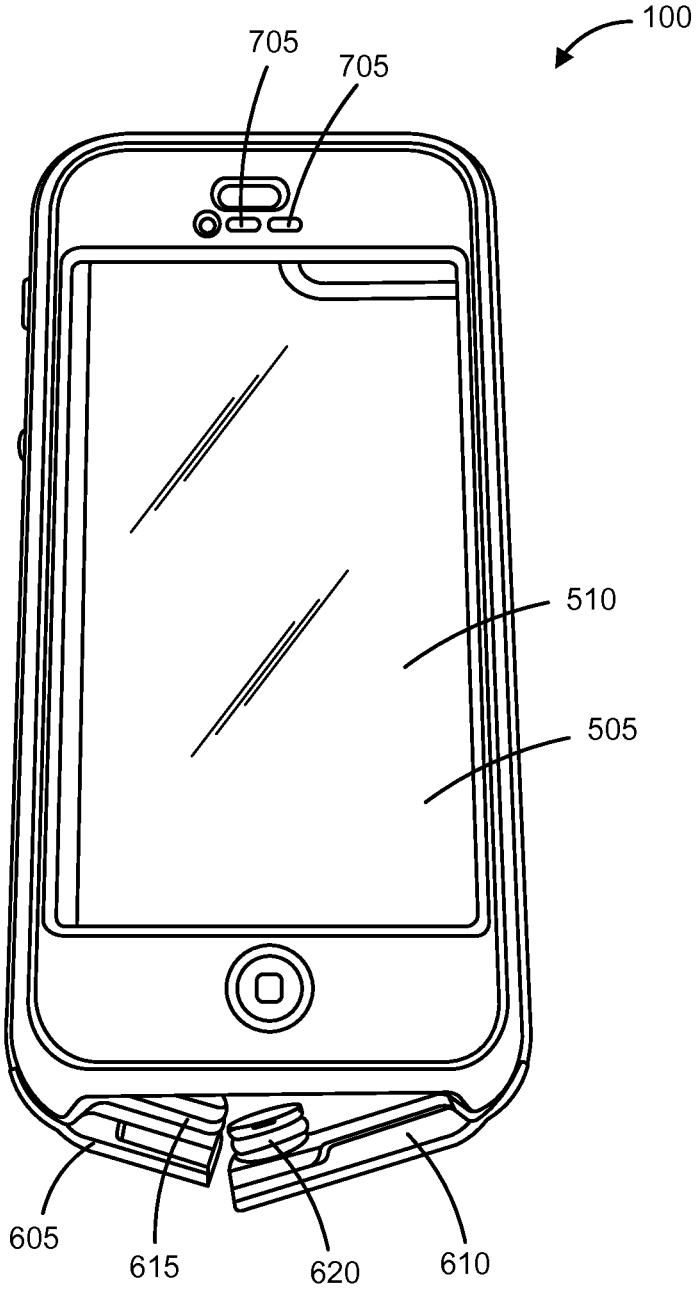
FIG. 8 is a front view of the protective case of FIG. 1 showing the first and second port covers in partially open positions.

The front portion 105 can include a second port cover 610 flexibly attached to the bottom side 125 of the front portion, as shown in FIGS. 5 and 13. The second port cover 610 can be configured to cover and seal a second port opening 640 in the bottom side of the front portion 105, as shown in FIG. 7. The second port cover 610 can also be configured to cover and seal a third port opening 645 in the bottom side of the front portion 105. The second port cover 610 can include a first O-ring 620 configured to seal against an inner surface of the third port opening 645 to provide a water-resistant seal when the second port cover is in a closed position. When in an open position, the second port cover 610 can provide access to features of the personal electronic device through the second and third port openings (640, 645). In one example, the second port cover 610 can be attached to the front portion 105 by inserting a feature of the second port cover into a slot 650 in the front portion, as shown in FIG. 14. The second port cover 610 can include a second hinge 655, as shown in FIG. 5, to permit flexing of the second port cover during opening and closing. In one example, the second hinge 655 can be a portion of the second port cover 610 having a relatively thinner cross-sectional area than adjacent portions of the port cover. When the second port cover 610 is in a closed position, it can permit sound to pass through the second port opening 640. In one example, the second port cover 605 can include an opening 660 extending to the second port opening 640, as shown in FIG. 7, and the second port opening can be covered with an acoustic membrane (e.g. an acoustic membrane made of GORE-TEX) that permits sound transmission.

Figure 3:
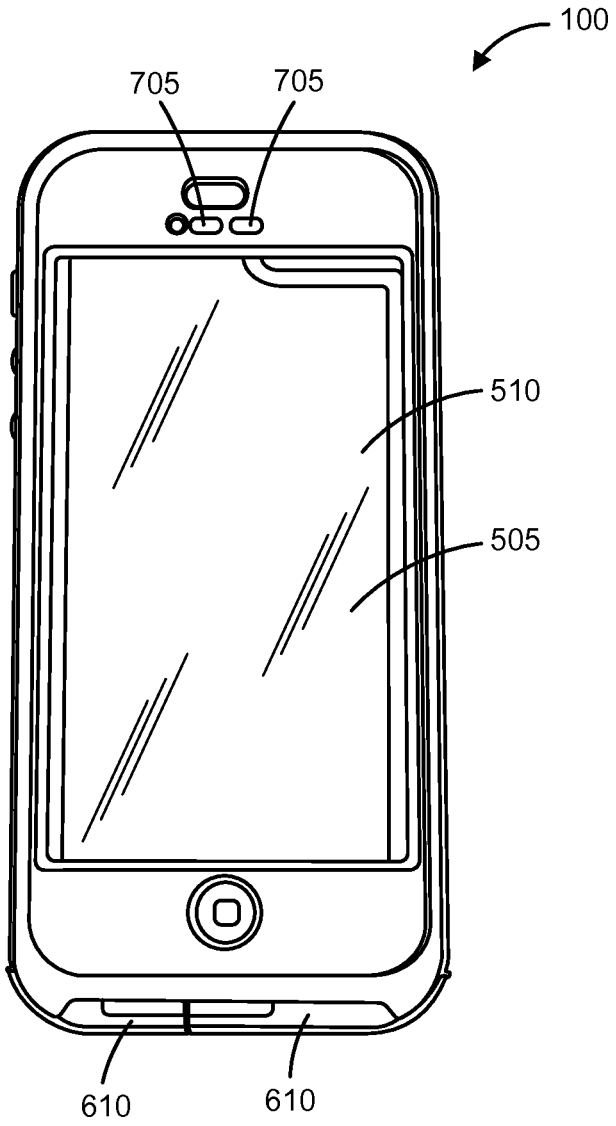
FIG. 3 is a front view of the protective case of FIG. 1.

The front portion 105 can include one or more speaker openings 705, as shown in FIG. 3. Each speaker opening 705 can be covered with a thin mesh layer to protect the speaker of the electronic device from physical damage, such as being punctured by a slender item (a key, paperclip, or pine needle) that inadvertently penetrates the speaker opening. The mesh layer can be covered with an acoustic membrane 715 that permits sound transmission, such as an acoustic membrane made of, for example, GORE-TEX, as shown in FIG. 17.

The front portion 105 can include a sound isolator 710 extending around the speaker opening. The sound isolator 710 can be adhered to an inner surface of the membrane 510. The sound isolator 710 can surround and isolate the speaker on a front surface of the personal electronic device and can be compressed against the front surface of the electronic device when the electronic device is installed in the protective case. The sound isolator 710 can prevent unwanted sounds, such as reverberations or echoes that occur within the protective case, from diminishing call quality. The sound isolator 710 provides significantly improved voice quality (e.g. clarity and volume) when compared to other commercially-available waterproof cases for smartphones.

FIG. 28 shows a second embodiment of a protective case 800 for an electronic device. The protective case 800 includes an overmolded gasket 240 that covers substantially the entire inner back surface 235 of the back portion 110. By covering substantially the entire inner back surface 235 with the overmolded gasket 240, no foam layer is needed, so manufacturing can be simplified by eliminating a manufacturing step and one component. The overmolded gasket 240 can provide impact protection and can prevent the electronic device from directly contacting the inner back surface 235 of the back portion 110, thereby serving a similar function as the foam layer it replaces. The overmolded gasket 805 can enhance the stiffness of the back portion 110, which can prevent flexing of the back portion and unwanted opening of the protective case 800 during an impact event, such as when the protective case is inadvertently dropped onto a hard surface.

As shown in Section A-A of FIG. 28, the overmolded gasket 240 can include a flexible sealing surface 405 configured to mate against the sealing surface 245 of the front portion 105. The overmolded gasket 240 can include a groove 410 located between the flexible sealing surface 405 and an inner gasket portion 415, which can cover substantially the entire inner back surface 235 of the back portion 110. The groove 410 can permit flexing of the flexible sealing surface 405 during assembly to provide a water-resistant seal between the flexible sealing surface and the sealing surface 245 of the front portion 105.

As shown in Section A-A of FIG. 28, the second layer 145 of the front portion 105 can be overmolded on the first layer 140 of the first portion. The second left side clasping feature 310 can extend from the left side surface 130 of the front portion 105. A sixth clasping surface 315 can be located on the back side surface 230 of the back portion 110. The second left side clasping feature 310 can engage the sixth clasping surface 315. The sixth clasping surface 315 can be oriented at an angle of approximately 30-60, 40-50, or 45 degrees inward with respect to the fourth plane that is coplanar with the left side surface 130 of the front portion 105 when the front portion is attached to the back portion 110.

FIG. 29 shows a third embodiment of a protective case 850 for an electronic device. As an alternative to an overmolded gasket, the protective case 850 can include a form-in-place gasket 855. The form-in-place gasket 855 can extend around the perimeter of the inner back surface 235 of the back portion 110. The form-in-place gasket 855 can include a flexible sealing surface 405 configured to mate against the sealing surface 245 of the front portion 105. The protective case 800 can include a foam layer 250, including any suitable material. In one example, the foam layer 250 can be made of urethane foam, and more specifically, a micro-cellular urethane foam such as PORON.

FIG. 30 shows a fourth embodiment of a protective case 900 for an electronic device. As an alternative to an overmolded gasket or a form-in-place gasket, the protective case 850 can include a removable O-ring 905. The O-ring 905 can extend around the perimeter of the inner back surface 235 of the back portion 110. The O-ring 905 can be installed in a channel 910 extending around the perimeter of the inner back surface 235 of the back portion 110, as shown in Section C-C. The O-ring 905 can include a flexible sealing surface 405 configured to mate against the sealing surface 245 of the front portion 105. The protective case 800 can include a foam layer 250, including any suitable material. In one example, the foam layer 250 can be made of urethane foam, and more specifically, a micro-cellular urethane foam such as PORON.

The foregoing description has been presented for purposes of illustration and description. It is not intended to be exhaustive or to limit the claims to the embodiments disclosed. Other modifications and variations may be possible in view of the above teachings. The embodiments were chosen and described to explain the principles of the invention and its practical application to enable others skilled in the art to best utilize the invention in various embodiments and various modifications as are suited to the particular use contemplated. It is intended that the claims be construed to include other alternative embodiments of the invention except insofar as limited by the prior art.

What is claimed is:

1. A waterproof protective case for a personal electronic device, the waterproof protective case comprising:

a front portion for enclosing at least a portion of the personal electronic device when the personal electronic device is installed in the waterproof protective case;

a back portion attachable to the front portion to form a waterproof cavity for the installed personal electronic device;

a first port opening on the waterproof protective case configured to access an audio feature of the installed personal electronic device, the first port opening covered by a water impermeable membrane configured to allow sound transmission through the waterproof protective case; and a flexible member attached to the waterproof protective case, a thinned portion of the flexible member defining a hinge, the hinge configured to allow the flexible member to flex away from the waterproof protective case in an open position, the flexible member including:

a port cover for covering and sealing a second port opening of the waterproof protective case when the flexible member is in a closed position, the second port opening proximate an electrical feature of the installed personal electronic device, in a gasket that seals the second port opening with the port cover of the waterproof protective case when the flexible member is in the closed position, and at least one aperture on the flexible member, the at least one aperture adjacent the port cover and configured to expose the first port opening of the waterproof protective case when the flexible member is in the closed position.

2. The waterproof protective case of claim 1, wherein the flexible member includes an attachment feature that slides into a slot in the waterproof protective case.

3. The waterproof protective case of claim 1, further comprising a second flexible member attached to the waterproof protective case, the second flexible member including a second port cover for covering and sealing a third port opening of the waterproof protective case, wherein the second flexible member includes a second aperture covered by an acoustic membrane to enable sound transmission from the installed personal electronic device through the second flexible member.

4. The waterproof protective case of claim 3, wherein the second flexible member seals a fourth port opening in addition to sealing the third port opening on the waterproof protective case.

5. The waterproof protective case of claim 1, further comprising at least one button feature for engaging a button on the surface of the personal electronic device.

6. The waterproof protective case of claim 1, further comprising:

at least two clasping features to attach the front and back portions to each other; and a gasket to establish a liquid-tight seal between the front and back portions.

7. The waterproof protective case of claim 1, further comprising a transparent membrane attached to the front portion of the waterproof protective case.

8. A waterproof protective case for an electronic device, the waterproof protective case comprising:

a front portion for enclosing at least a portion of the electronic device when the electronic device is installed in the waterproof protective case;

a back portion attachable to the front portion to form a waterproof cavity for the installed electronic device;

a first port cover attached to a first flexible member, the first port cover for covering and sealing a first port opening of the waterproof protective case when the first flexible member is in a closed position, the first port opening proximate a first feature of the installed electronic device, the first flexible member attached to the waterproof protective case and having a hinge from a thinned area of the first flexible member, the hinge to allow the first port cover to flex away from the first port opening when the first flexible member is in an opened position;

a second port cover attached to a second flexible member, the second port cover for covering and sealing a second port opening of the waterproof protective case when the second flexible member is in a closed position, the second port opening proximate a second feature of the installed electronic device, the second flexible member attached to the waterproof protective case and having a hinge from a thinned area of the second flexible member to allow the second port cover to flex away from the second port opening when the second flexible member is in an opened position; and a third port opening covered by a water impermeable membrane proximate an audio feature of the installed electronic device, the third port opening adjacent the second port opening and covered by the second flexible member when the second flexible member is in the closed position and the second port cover is covering and sealing the second port opening.

9. The waterproof protective case of claim 8, wherein the first port cover and the second port cover each include a gasket that seals the first port opening and the second port opening, respectively, when the first flexible member and the second flexible member are in the closed positions.

10. The waterproof protective case of claim 8, wherein at least one of the first or second flexible member includes an attachment feature that slides into a slot in the waterproof protective case.

11. The waterproof protective case of claim 8, wherein the second flexible member includes an aperture adjacent the second port cover, the aperture exposing the third port opening through the second flexible member when the second flexible member is in the closed position.

12. The waterproof protective case of claim 8, wherein the first flexible member has at least one opening to allow sound transmission through the first flexible member.

13. The waterproof protective case of claim 8, further comprising a transparent membrane attached to the front portion of the waterproof protective case.

14. The waterproof protective case of claim 8, further comprising at least one button feature for engaging a button on the surface of the electronic device.

15. The waterproof protective case of claim 8, further comprising:

at least two clasping features to attach the front and back portions to each other; and a gasket to establish a liquid-tight seal between the front and back portions.

16. The waterproof protective case of claim 8, wherein the first flexible member seals a fourth port opening in addition to the first port opening on the waterproof protective case.

17. A waterproof protective case for a personal electronic device, the waterproof protective case comprising:

a first portion for enclosing at least a portion of the personal electronic device when the personal electronic device is installed in the waterproof protective case;

a second portion attachable to the first portion to form a waterproof cavity for the installed personal electronic device;

a port cover for covering and sealing a first port opening of the waterproof protective case, the first port opening proximate an electrical port of the installed personal electronic device, the port cover attached to a flexible member, the flexible member attached to the waterproof protective case and including a hinge formed from a thinned area of the flexible member to allow the port cover to flex away from the first port opening when the flexible member is in an open position;

a gasket that seals the first port opening of the waterproof protective case when the flexible member is in a closed position and the port cover is covering and sealing the first port opening; and a second port opening covered by a water impermeable membrane proximate an audio feature of the installed personal electronic device, the second port opening proximate the first port opening and covered by the flexible member when the flexible member is in the closed position, the flexible member including at least one aperture that exposes the water impermeable membrane covering the second port opening when the flexible member is in the closed position.

18. The waterproof protective case of claim 17, further comprising:

a second port cover for covering and sealing a third port opening of the waterproof protective case, the second port cover attached to a second flexible member, the second flexible member attached to the waterproof protective case, the second flexible member having a hinge formed from a thinned area of the second flexible member that allows the second port cover to flex away from the third port opening when the second flexible member is in an opened position.

19. The waterproof protective case of claim 17, wherein the flexible member includes an attachment feature that slides into a slot in the waterproof protective case.

20. The waterproof protective case of claim 17, further comprising a switch engager configured to engage a rocker switch of the personal electronic device.

21. The waterproof protective case of claim 17, wherein the second portion of the waterproof protective case comprises a camera flash isolator.

22. The waterproof protective case of claim 17, further comprising a transparent membrane attached to the first portion of the waterproof protective case.

23. The waterproof protective case of claim 17, further comprising at least one button feature for engaging a button on the surface of the personal electronic device.

24. The waterproof protective case of claim 17, further comprising:

at least two clasping features to attach the first and second portions to each other; and a gasket to establish a liquid-tight seal between the first and second portions.

* * * * *